US006548166B2

(12) United States Patent
Figuly et al.

(10) Patent No.: US 6,548,166 B2
(45) Date of Patent: Apr. 15, 2003

(54) STRETCHABLE FIBERS OF POLYMERS, SPINNERETS USEFUL TO FORM THE FIBERS, AND ARTICLES PRODUCED THEREFROM

(75) Inventors: Garret D. Figuly, Wilmington, DE (US); Anthony J. Soroka, Hixson, TN (US); Marc B. Goldfinger, West Chester, PA (US); Rakesh H. Mehta, Hockessin, DE (US); H. Vaughn Samuelson, Chadds Ford, PA (US); Gregory P. Weeks, Hockessin, DE (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 09/966,037

(22) Filed: Sep. 28, 2001

(65) Prior Publication Data

US 2002/0106509 A1 Aug. 8, 2002

Related U.S. Application Data

(60) Provisional application No. 60/236,144, filed on Sep. 29, 2000, and provisional application No. 60/236,145, filed on Sep. 29, 2000.

(51) Int. Cl.[7] ..... D01F 8/00; D01F 8/12; D01D 5/08; D01D 5/088

(52) U.S. Cl. ..... 428/370; 428/373; 428/374; 428/397; 264/172

(58) Field of Search ..... 428/370, 373, 428/374, 397; 57/140; 264/172.12, 172.14

(56) References Cited

U.S. PATENT DOCUMENTS

| | | | |
|---|---|---|---|
| 2,936,482 A | | 5/1960 | Kilian |
| 3,017,686 A | | 1/1962 | Breen et al. |
| 3,418,200 A | | 12/1968 | Tanner |
| 3,458,390 A | | 7/1969 | Ando et al. |
| 3,468,975 A | | 9/1969 | Duxbury et al. |

(List continued on next page.)

FOREIGN PATENT DOCUMENTS

| | | | |
|---|---|---|---|
| DE | 19045 | | 6/1960 |
| EP | 0233702 | A2 | 8/1987 |
| JP | 5921776 | A | 2/1984 |
| JP | 61289124 | A | 12/1986 |
| JP | 06025919 | A | 2/1994 |
| JP | 95-2819 | | 3/1995 |
| JP | Hei6-150524 | | 12/1995 |
| JP | 97078432 | | 3/1997 |
| WO | WO 9745575 | A1 | 12/1997 |
| WO | WO 0116232 | A1 | 3/2001 |

OTHER PUBLICATIONS

Additional Observations On Stratified Bicomponent Flow of Polymer Melts In A Tube, Journal of Polymer Science: Polymer Physics Edition, 1975, pp. 863–869, vol. 13, John Wiley & Sons, Inc. (No Month).

Fitzgerald, W.E. and Knudsen, J. P., Mixed–Stream Spinning of Bicomponent Fibers, Textile Research Journal, 1967, pp. 447–453. (No Month).

Hagewood, John, Ultra Microfibers: Beyond Evolution, IFJ, 1998, pp. 47–48. (No Month).

*Primary Examiner*—N. Edwards

(57) ABSTRACT

A stretchable synthetic polymer fiber comprising an axial core formed from an elastomeric polymer, and two or more wings attached to the core and formed from a non-elastomeric polymer, wherein preferably at least one of the wings is mechanically locked with the axial core. The fibers can be used to form garments, such as hosiery. A spinneret pack for producing such fibers is also provided.

13 Claims, 15 Drawing Sheets

U.S. PATENT DOCUMENTS

| | | | | | |
|---|---|---|---|---|---|
| 3,787,162 | A | | 1/1974 | Cheetham | |
| 4,041,689 | A | * | 8/1977 | Duncan | 57/140 |
| 4,385,886 | A | | 5/1983 | Samuelson | |
| 4,810,770 | A | | 3/1989 | Greene et al. | |
| 4,861,660 | A | | 8/1989 | Ishii | |
| 4,985,536 | A | | 1/1991 | Figuly | |
| 5,162,074 | A | | 11/1992 | Hills | |
| 5,171,633 | A | | 12/1992 | Muramoto et al. | |
| 5,260,013 | A | | 11/1993 | Samuelson | |
| 5,344,297 | A | | 9/1994 | Hills | |
| 5,603,888 | A | | 2/1997 | Blizzard et al. | |
| 5,677,057 | A | | 10/1997 | Tashiro et al. | |
| 5,686,121 | A | | 11/1997 | Samuelson | |
| 5,972,502 | A | | 10/1999 | Jessee et al. | |

* cited by examiner

STRETCHABLE FIBERS OF POLYMERS, SPINNERETS USEFUL TO FORM THE FIBERS, AND ARTICLES PRODUCED THEREFROM

RELATED APPLICATIONS

This application claims priority of U.S. Provisional Patent Applications Nos. 60/236,144 and 60/236,145, both filed Sep. 29, 2000.

BACKGROUND OF THE INVENTION

1. Field of the Invention

The present invention relates to a stretchable synthetic polymer fiber having an axial core comprising a thermoplastic elastomeric polymer and a plurality of radially spaced wings attached to the outer periphery of the core comprising a thermoplastic, non-elastomeric polymer. At least one of the wing polymer or the core polymer protrudes into the other polymer to improve attachment of the wings to the core. The invention also relates to methods of producing such fibers, and a spinneret pack useful to form the fibers. The invention also relates to articles formed from the fibers, including yarns, garments, and the like.

2. Description of Related Art

It is desired to impart stretchability into many products formed from synthetic fibers, including various garments, such as sportswear and hosiery. As disclosed in the background section of U.S. Pat. No. 4,861,660 to Ishii, various methods are known for imparting stretchability to synthetic filaments. In one method, the fibers are two- or three-dimensionally crimped. In another such method, stretchable filaments are produced from elastic polymers, for example, natural or synthetic rubber, or a synthetic elastomer, such as polyurethane elastomer. This type of stretchable filament is disadvantageous in that the rubber or polyurethane elastomer filaments per se exhibit very poor wearing and knitting processability and poor dyeing properties. Therefore, the disadvantage of the rubber of polyurethane elastomer filaments is avoided by covering the rubber or elastomer filament with another type of filament having a satisfactory processability and dyeing property.

However, there are drawbacks associated with such covered elastomeric filaments. Ishii attempts to overcome such drawbacks by imparting asymmetry to filaments which are formed from two polymers. Nevertheless, these fibers often suffer from a serious defect in that the two polymers are often easily delaminated from each other during processing. The resulting split fiber has low break tenacity and can result in fabrics having less than intended sheerness and thermal conductivity. See also U.S. Pat. No. 3,017,686 to Breen et al., which discloses fibers formed from two different non-elastomeric polymers and which suffers from these drawbacks.

In fact, it is recognized in U.S. Pat. No. 3,418,200 to Tanner that under certain conditions having the core polymer protrude into the wing polymer will in fact make the portion of the wing which is formed from a different polymer than the core and the protruding portions of the wings more readily separable from the protruding portions. In contrast, at times it may be desirable to improve the attachment of two different polymers in a filament, as disclosed in U.S. Pat. No. 3,458,390, where a type of mechanical locking has been used to bond two high modulus, low elasticity polymers together. However, such polymers, as well as those disclosed in Breen and in Tanner, because of their low elasticity, have inadequate stretch and recovery properties for the high-stretch garments desirable today.

Fibers containing two polymers can be spun with the spinnerets disclosed in U.S. Pat. No. 3,418,200 and U.S. Pat. No. 5,344,297. However, the spinnerets of these patents exhibit polymer migration when multiple polymer streams are combined in feed channels substantially before the spinneret. These problems are described in the *Journal Of Polymer Science* [Physics Edition] Volume 13(5) p.863, 1975, and are shown specifically and most recently in the *International Fiber Journal* (1998), Volume 13(5) p.48, for otherwise state-of-the-art spinning of a trilobal fiber with tips which are designed to split from the core.

Thus, there is still a need for fibers and articles therefrom that have excellent stretch and recovery and that retain their tenacity during processing and use and for convenient methods of making such fibers and articles. There is also a need for spinnerets for spinning two polymers which eliminates problems in polymer migration when multiple polymer streams are combined in feed channels substantially before the spinneret orifice.

SUMMARY OF THE INVENTION

It has now been found that splitting (delamination) within a stretchable two-polymer fiber can be substantially reduced or eliminated if one of the two polymers penetrates the other polymer, that is, at least a portion of a wing polymer of one or more wings protrudes into the core polymer or at least a portion of the core polymer protrudes into a wing polymer. Such behavior was unexpected because it was anticipated that, under stress, the elastomeric polymer would readily deform and pull out of the interpenetrated connection with the non-elastomeric polymer, especially in light of the teachings of Tanner, supra.

In accordance with these findings, the present invention provides for a stretchable synthetic polymer fiber including an axial core comprising a thermoplastic, elastomeric polymer and a plurality of wings attached to the core comprising a thermoplastic, non-elastomeric polymer, wherein at least one of the wing polymer or core polymer protrudes into the other polymer. In one embodiment, the axial core contains an outer radius $R_1$, an inner radius $R_2$, and $R_1/R_2$ is greater than about 1.2.

In another embodiment, the invention provides for a stretchable synthetic polymer fiber including an axial core comprising a first polymer and a plurality of wings attached to the core comprising a second polymer, wherein the fiber has a delamination rating of less than about 1 and an after boil-off stretch of at least about 20%.

Moreover, with the spinneret pack of the present invention, it is possible to directly meter multicomponent polymer streams into specific points at the backside entrance of the fiber forming orifice in the spinneret plate. This eliminates problems in polymer migration when multiple polymer streams are combined in feed channels substantially before the spinneret orifice.

Thus, further in accordance with the present invention, there is provided a spinneret pack for the melt extrusion of a plurality of synthetic polymer to produce fiber, comprising: a metering plate containing a first set of holes adapted to receive a first polymer melt and a second set of holes adapted to receive a second polymer melt; a spinneret plate aligned and in contact with the metering plate, the spinneret plate having capillaries therethrough and having a counterbore length of less than about 60% of the length of the spinneret capillaries; and a spinneret support plate having holes larger than the capillaries, aligned and in contact with the spinneret plate; wherein the plates are aligned such that the plurality of polymers fed to the metering plate pass through the spinneret plate and the spinneret support plate to form a fiber.

BRIEF DESCRIPTION OF THE DRAWINGS

FIG. 9 shows in cross-sectional cut-away a representation a prior art spinneret plate.

DETAILED DESCRIPTION OF THE INVENTION

The present invention provides a stretchable synthetic polymer fiber, shown generally shown generally at 10 in FIGS. 1, 2, 3, 4, 5, 6, 11 and 12. The fiber of the present invention includes an axial core, shown at 12 in FIGS. 1 and 2 and a plurality of wings, shown at 14 in FIGS. 1 and 2. The axial core comprises a thermoplastic elastomeric polymer, the wings comprise at least one thermoplastic, non-elastomeric polymer attached to the core. Preferably, the thermoplastic, non-elastomeric polymer is permanently drawable.

As used herein, the term "fiber" is interchangeable with the term "filament". The term "yarn" includes yarns of a single filament. The term "multifilament yarn" generally relates to yarns of two or more filaments. The term "thermoplastic" refers to a polymer which can be repeatedly melt-processed (for example melt-spun). By 'elastomeric polymer' is meant a polymer which in monocomponent fiber form, free of diluents, has a break elongation in excess of 100% and which when stretched to twice its length, held for one minute, and then released, retracts to less than 1.5 times its original length within one minute of being released. The elastomeric polymers in the fiber of the invention can have a flex modulus of less than about 14,000 pounds per square inch (96,500 kPascals), more typically less than about 8500 pounds per square inch (58,600 kPascals) when present in a monocomponent fiber spun according to ASTM Standard D790 Flexural Properties at RT or 23° C. and under conditions substantially as described herein. As used herein, "non-elastomeric polymer" means any polymer which is not an elastomeric polymer. Such polymers can also be termed "low elasticity", "hard: and "high modulus". By "permanently drawable" is meant that the polymer has a yield point, and if the polymer is stretched beyond such point it will not return to its original length.

The fibers of the invention are termed "biconstituent" fibers when they are comprised of at least two polymers adhered to each other along the length of the fiber, each polymer being in a different generic class, e.g., polyamide, polyester or polyolefin. If the elastic characteristics of the polymers are sufficiently different, polymers of the same generic class can be used, and the resulting fiber is a "bicomponent" fiber. Such bicomponent fibers are also within the scope of the invention.

Figure 1:
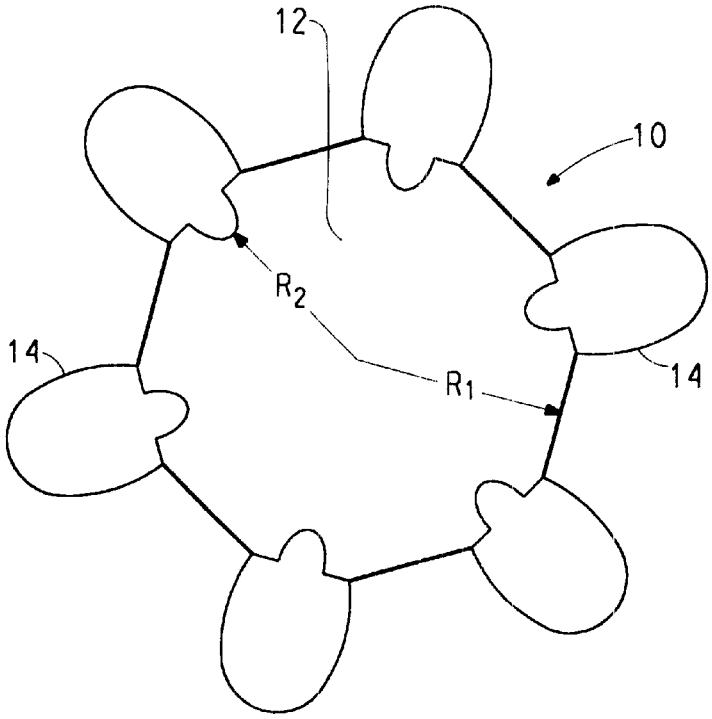
FIG. 1 is a cross-sectional representation of a fiber of the invention with the wing polymer protruding into the core.
Figure 2:
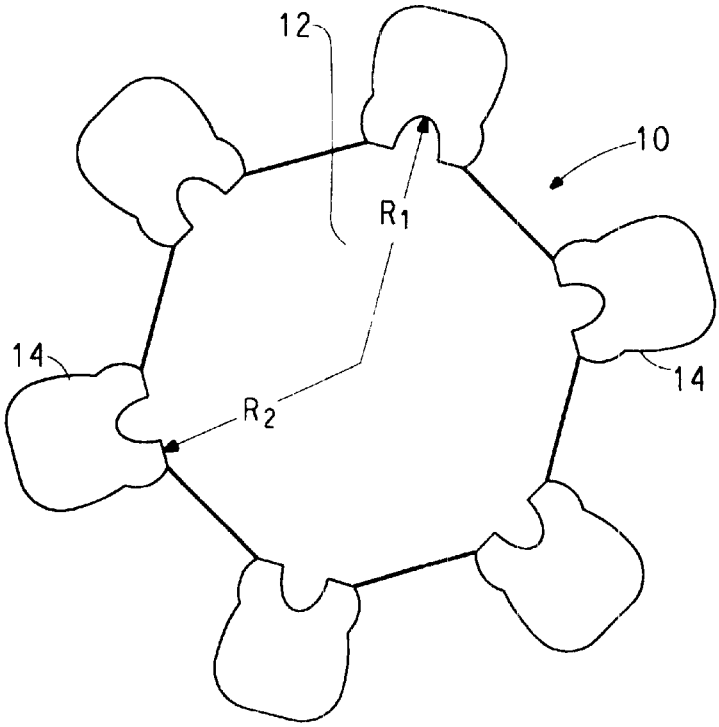
FIG. 2 is a cross-sectional representation of a fiber of the invention with the core polymer protruding into the wing.
Figure 4:
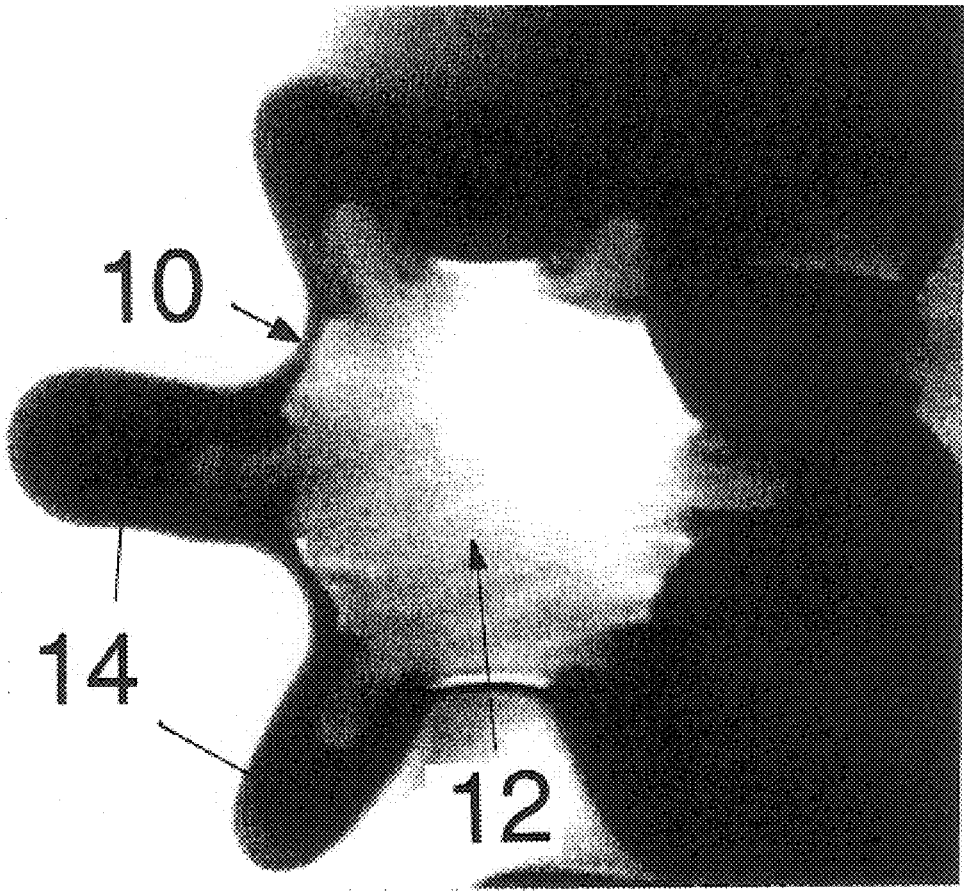
FIG. 4 is a cross-sectional representation of an embodiment of the fiber of the invention, where the protruding polymer, for example the core polymer, protrudes so far into the penetrated polymer, for example the wing polymer, that the penetrating polymer is like a spline.
Figure 5:
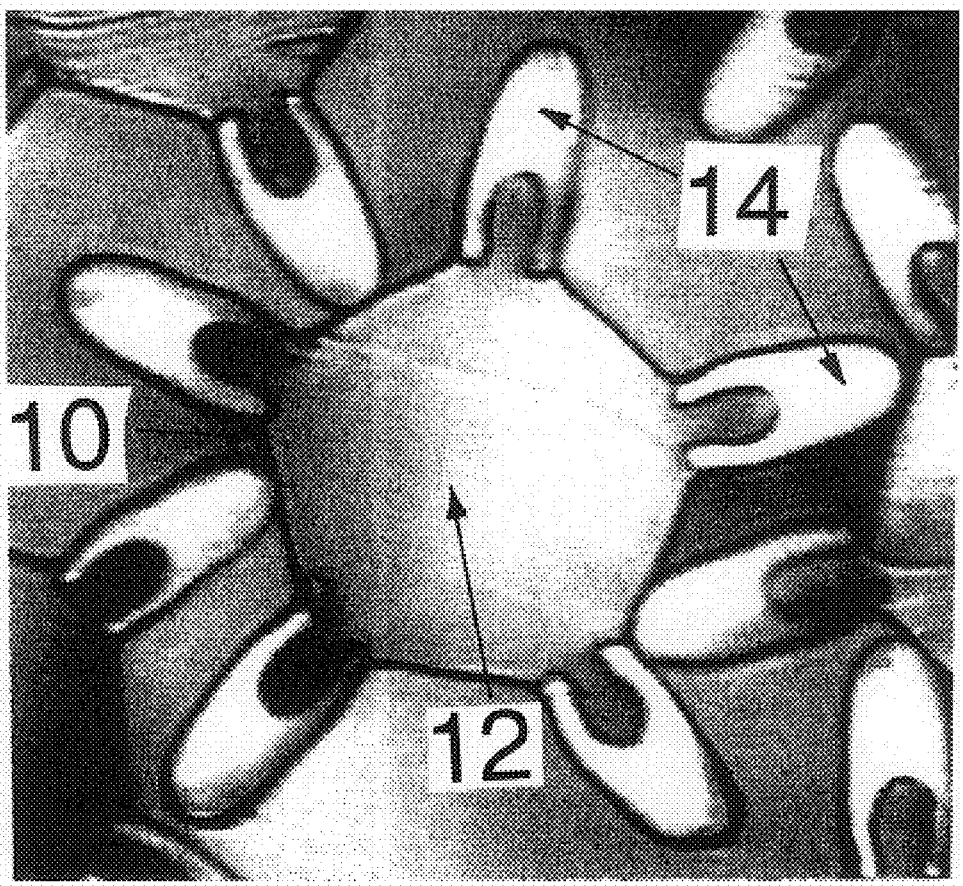
FIG. 5 is a cross-sectional representation of an embodiment of the fiber of the invention where the core polymer protrudes into the wing polymer and includes a remote enlarged end section and a reduced neck section joining the end section to the remainder of the core polymer to form at least one necked-down portion therein.
Figure 6:
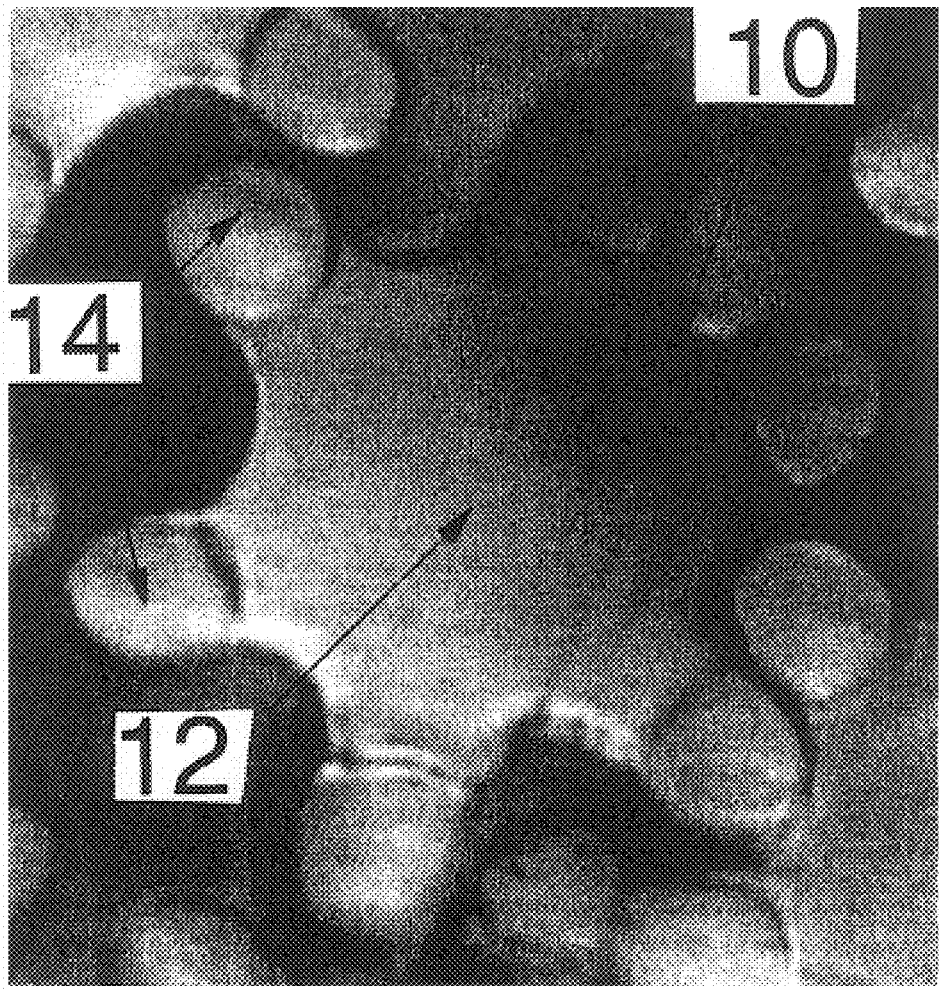
FIG. 6. is a cross-sectional representation of an embodiment of the fiber of the invention where the core surrounds a portion of the side of one or more wings, such that a wing penetrates the core.

According to the invention, at least one of the wing polymer and the core polymer protrudes into the other polymer. FIG. 1 shows the wing polymer protruding into the core polymer, and FIG. 2 shows the core polymer protruding into the wing polymer. The penetration of core and wing polymers can be accomplished by any method effective for reducing splitting of the fiber. For example, in one embodiment, the penetrating polymer (for example the wing polymer) can protrude into the penetrated polymer (for example the core polymer) like the roots of a tooth, so that a plurality of protrusions are formed (see FIG. 3). In another embodiment, the penetrating polymer (for example the core polymer) can protrude so far into the penetrated polymer (for example the wing polymer), that the penetrating polymer is like a spline (see FIG. 4). A spline has substantively uniform diameter. In yet another embodiment, at least one polymer can have at least one protruding portion, of a single wing into core or core into wing, which includes a remote enlarged end section and a reduced neck section joining the end section to the remainder of the at least one polymer to form at least one necked-down portion therein. FIG. 5 shows the core polymer protruding into each wing polymer, and having such a remote enlarged end section 16 and a reduced neck section 18. Wings and core attached to each other by such an enlarged end section and reduced neck section are referred to as 'mechanically locked'. For ease of manufacture and more effective adhesion between wings and core, the last-mentioned embodiment having a reduced neck section is often preferred. Other protrusion methods can be envisioned by those skilled in the art. For example, as seen in FIG. 6, the core can surround a portion of the side of one or more wings, such that a wing penetrates the core.

The fiber of the invention includes an axial core with an outer radius and an inner radius (for example "$R_1$" and "$R_2$", respectively, in FIGS. 1 and 2). The outer radius is that of a circle circumscribing the outermost portions of the core, and the inner radius is that of a circle inscribing the innermost portions of the wings. In the fibers of the invention, $R_1/R_2$ is generally greater than about 1.2. It is preferred that $R_1/R_2$ be in the range of about 1.3 to about 2.0. Resistance to delamination can decline at lower ratios, and at higher ratios the high levels of elastomeric polymer in the wings (or of non-elastomeric polymer in the core) can decrease the stretch and recovery of the fiber. When the core forms a spline within the wing, $R_1/R_2$ approaches 2. In contrast, in a fiber where one of the wing or core polymer does not protrude into the other polymer, $R_1$ approximates $R_2$, so that neither wings nor core penetrate the other. In cases in which among the plurality of wings, the polymer in some wings penetrates the core polymer while the polymer in other wings is penetrated by the core polymer, $R_1$ and $R_2$ are determined only as pairs corresponding to each wing, as illustrated in FIG. 2, and each ratio $R_1/R_2$ and $R_1'/R_2'$ is generally greater than about 1.2, preferably in the range of about 1.3 to 2.0. In another embodiment, some wings can be penetrated by core polymer while adjacent wings are not penetrated, and $R_1$ and $R_2$ are determined in relationship to penetrated wings; similarly, $R_1$ and $R_2$ are determined in relationship to penetrating wings when only some parts of the core are penetrated by wing polymer. Any combination of core into wing, wing into core, and no penetration can be used for the wings so long as at least one wing penetrates core or is penetrated by core.

The fiber of the present invention is twisted around its longitudinal axis, without significant two- or three-dimensional crimping characteristics. (In such higher-dimensional crimping, a fiber's longitudinal axis itself assumes a zig-zag or helical configuration; such fibers are not of the invention). The fiber of the present invention may be characterized as having substantially spiral twist and one dimensional spiral twist. "Substantially spiral twist" includes both spiral twist that passes completely around the elastomeric core and also spiral twist that passes only partly around the core, since it has been observed that a fully 360° spiral twist is not necessary to achieve the desirable stretch properties in the fiber. The substantially spiral twist can be either almost completely circumferential, or almost completely noncircumferential. "One dimensional" spiral twist means that while the wings of the fiber can be substantially spiral, the axis of the fiber is substantially straight even at low tension, in contrast to fibers having 2- or 3-dimensional crimp. However, fibers having some waviness are within the scope of the invention.

The presence or absence of two- and three-dimensional crimp can be gauged from the amount of stretch needed to substantially straighten the fiber (by pulling out any non-linearities) and is a measure of the radial symmetry of fibers having spiral twist. The fiber of the invention can require less than about 10% stretch, more typically less than about 7% stretch, for example about 4% to about 6%, to substantially straighten the fiber.

The fiber of the present invention has a substantially radially symmetric cross-section, as can be seen in particular from FIGS. 1 and 2. By "substantially radially symmetric cross-section" is meant a cross-section in which the wings are located and are of dimensions so that rotation of the fiber about its longitudinal axis by 360/n degrees, in which "n" is an integer representing the "n-fold" symmetry of the fibers, results in substantially the same cross-section as before rotation. The cross-section is substantially symmetrical in terms of size, polymer and angular spacing around the core. This substantially radially symmetric cross-section impartes an unexpected combination of high stretch and high uniformity without significant levels of two- or three-dimensional crimp. Such uniformity is advantageous in high-speed processing of fibers, for example through guides and knitting needles, and in making smooth, non-'picky' fabrics, especially sheer fabrics like hosiery. Fibers which have a substantially radially symmetric cross-section possess no self-crimping potential, i.e., they have no significant two- or three-dimensional crimping characteristics. See generally *Textile Research Journal*, June 1967, p. 449.

For maximum cross-sectional radial symmetry, the core can have a substantially circular or a regular polyhedral cross-section, e.g., as seen in FIGS. 1 and 2. By "substantially circular" it is meant that the ratio of the lengths of two axes crossing each other at 90° in the center of the fiber cross-section is no greater than about 1.2:1. The use of a substantially circular or regular polyhedron core, in contrast to the cores of U.S. Pat. No. 4,861,660, can protect the elastomer from contact with the rolls, guides, etc. as described later with reference to the number of wings. The plurality of wings can be arranged in any desired manner around the core, for example, discontinuously as depicted in FIGS. 1 and 2, i.e., the wing polymer does not form a continuous mantel on the core, or with adjacent wing(s) meeting at the core surface, e.g., as illustrated in FIGS. 4 and 5 of U.S. Pat. No. 3,418,200. The wings can be of the same or different sizes, provided a substantially radial symmetry is preserved. Further, each wing can be of a different polymer from the other wings, once again provided substantially radial geometric and polymer composition symmetry is maintained. However, for simplicity of manufacture and ease of attaining radial symmetry, it is preferred that the wings be of approximately the same dimensions, and be made of the same polymer or blend of polymers. It is also preferred that the wings discontinuously surround the core for ease of manufacture.

While the fiber cross-section is substantially symmetrical in terms of size, polymer, and angular spacing around the core, it is understood that small variations from perfect symmetry generally occur in any spinning process due to such factors as non-uniform quenching or imperfect polymer melt flow or imperfect spinning orifices. It is to be understood that such variations are permissible provided that they are not of a sufficient extent to detract from the objects of the invention, such as providing fibers of desired stretch and recovery via one-dimensional spiral twist, while minimizing two- and three-dimensional crimping. That is, the fiber is not intentionally made asymmetrical as in U.S. Pat. No. 4,861,660.

The wings protrude outward from the core to which they adhere and form a plurality of spirals at least part way around the core especially after effective heating. The pitch of such spirals can increase when the fiber is stretched. The fiber of the invention has a plurality of wings, preferably 3–8, more preferably 5 or 6. The number of wings used can depend on other features of the fiber and the conditions under which it will be made and used. For example, 5 or 6 wings can be used when a monofilament is being made, especially at higher draw ratios and fiber tensions. In this case the wing spacing can be frequent enough around the core that the elastomer is protected from contact with rolls, guides, and the like and therefore less subject to breaks, roll wraps and wear than if fewer wings were used. The effect of higher draw ratios and fiber tensions is to press the fiber harder against rolls and guides, thus splaying out the wings and bringing the elastomeric core into contact with the roll or guide; hence the preference for more than two wings at high draw ratios and fiber tensions. In monofilaments, five or six wings are often preferred for an optimum combination of ease of manufacture and reduced core contact. When a multifiber yarn is desired, as few as two or three wings can be used because the likelihood of contact between the elastomeric core and rolls or guides is reduced by the presence of the other fibers.

While it is preferred that the wings discontinuously surround the core for ease of manufacture, the core may include on its outside surface a sheath of a non-elastomeric polymer between points where the wings contact the core. The sheath thickness can be in the range of about 0.5% to about 15% of the largest radius of the fiber core. The sheath can help with adhesion of the wings to the core by providing more contact points between the core and wing polymers, a particularly useful feature if the polymers in the biconstituent fiber do not adhere well to each other. The sheath can also reduce abrasive contact between the core and rolls, guides, and the like, especially when the fiber has a low number of wings.

The core and/or wings of the multiwinged cross-section of the present invention may be solid or include hollows or voids. Typically, the core and wings are both solid. Moreover, the wings may have any shape, such as ovals, T-, C-, or S-shapes (see, for example, FIG. 4). Examples of useful wing shapes are found in U.S. Pat. No. 4,385,886. T, C, or S shapes can help protect the elastomer core from contact with guides and rolls as described previously.

The weight ratio of total wing polymer to core polymer can be varied to impart the desired mix of properties, e.g., desired elasticity from the core and other properties such as low tackiness from the wing polymer. For example, a weight ratio of about 10/90 to about 70/30, preferably about 30/70 to about 40/60 of wing to core can be used. For high durability combined with high stretch in uses in which the fiber need not be used with a companion yarn (for example hosiery), a wing/core weight ratio of about 35/65 to about 50/50 is preferred. For best adhesion between the core and wings, typically about 5 wt % to about 30 wt % of the total fiber weight can be non-elastic polymer penetrating the core, or elastic core polymer penetrating the wings.

As noted above, the core of the fiber of the invention can be formed from any thermoplastic elastomeric polymer. Examples of useful elastomers include thermoplastic polyurethanes, thermoplastic polyester elastomers, thermoplastic polyolefins, thermoplastic polyesteramide elastomers and thermoplastic polyetheresteramide elastomers.

Useful thermoplastic polyurethane core elastomers include those prepared from a polymeric glycol, a diisocyanate, and at least one diol or diamine chain extender. Diol chain extenders are preferred because the polyurethanes made therewith have lower melting points than if a diamine chain extender were used. Polymeric glycols useful in the preparation of the elastomeric polyurethanes include polyether glycols, polyester glycols, polycarbonate glycols and copolymers thereof. Examples of such glycols include poly(ethyleneether) glycol, poly(tetramethyleneether) glycol, poly(tetramethylene-co-2-methyl-tetramethyleneether) glycol, poly(ethylene-co-1,4-butylene adipate) glycol, poly(ethylene-co-1,2-propylene adipate) glycol, poly(hexamethylene-co-2,2-dimethyl-1,3-propylene adipate), poly(3-methyl-1,5-pentylene adipate) glycol, poly (3-methyl-1,5-pentylene nonanoate) glycol, poly(2,2-dimethyl-1,3-propylene dodecanoate) glycol, poly(pentane-1,5-carbonate) glycol, and poly(hexane-1,6-carbonate) glycol. Useful diisocyanates include 1-isocyanato-4-[(4-isocyanatophenyl)methyl]benzene, 1-isocyanato-2-[(4-isocyanato-phenyl)methyl]benzene, isophorone diisocyanate, 1,6-hexanediisocyanate, 2,2-bis(4-isocyanatophenyl)propane, 1,4-bis(p-isocyanato,alpha, alpha-dimethylbenzyl)benzene, 1,1'-methylenebis(4-isocyanatocyclohexane), and 2,4-tolylene diisocyanate. Useful diol chain extenders include ethylene glycol, 1,3 propane diol, 1,4-butanediol, 2,2-dimethyl-1,3-propylene diol, diethylene glycol, and mixtures thereof. Preferred polymeric glycols are poly(tetramethyleneether) glycol, poly(tetramethylene-co-2-methyl-tetramethyleneether) glycol, poly(ethylene-co-1,4-butylene adipate) glycol, and poly(2,2-dimethyl-1,3-propylene dodecanoate) glycol. 1-Isocyanato-4-[(4-isocyanatophenyl)methyl]benzene is a preferred diisocyanate. Preferred diol chain extenders are 1,3 propane diol and 1,4-butanediol. Monofunctional chain terminators such as 1-butanol and the like can be added to control the molecular weight of the polymer.

Useful thermoplastic polyester elastomers include the polyetheresters made by the reaction of a polyether glycol with a low-molecular weight diol, for example, a molecular weight of less than about 250, and a dicarboxylic acid or diester thereof, for example, terephthalic acid or dimethyl terephthalate. Useful polyether glycols include poly (ethyleneether) glycol, poly(tetramethyleneether) glycol, poly(tetramethylene-co-2-methyltetramethyleneether) glycol [derived from the copolymerization of tetrahydrofuran and 3-methyltetrahydrofuran] and poly(ethylene-co-tetramethyleneether) glycol. Useful low-molecular weight diols include ethylene glycol, 1,3 propane diol, 1,4-butanediol, 2,2-dimethyl-1,3-propylene diol, and mixtures thereof; 1,3 propane diol and 1,4-butanediol are preferred. Useful dicarboxylic acids include terephthalic acid, optionally with minor amounts of isophthalic acid, and diesters thereof (e.g., <20 mol %).

Useful thermoplastic polyesteramide elastomers that can be used in making the core of the fibers of the invention include those described in U.S. Pat. No. 3,468,975. For example, such elastomers can be prepared with polyester segments made by the reaction of ethylene glycol, 1,2-propanediol, 1,3-propanediol, 1,4-butanediol, 2,2-dimethyl-1,3-propanediol, 1,5-pentanediol, 1,6-hexanediol, 1,10-decandiol, 1,4-di(methylol)cyclohexane, diethylene glycol, or triethylene glycol with malonic acid, succinic acid, glutaric acid, adipic acid, 2-methyladipic acid, 3-methyladipic acid, 3,4-dimethyladipic acid, pimelic acid, suberic acid, azelaic acid, sebacic acid, or dodecandioic acid, or esters thereof. Examples of polyamide segments in such polyesteramides include those prepared by the reaction of hexamethylene diamine or dodecamethylene diamine with terephthalic acid, oxalic acid, adipic acid, or sebacic acid, and by the ring-opening polymerization of caprolactam.

Thermoplastic polyetheresteramide elastomers, such as those described in U.S. Pat. No. 4,230,838, can also be used to make the fiber core. Such elastomers can be prepared, for example, by preparing a dicarboxylic acid-terminated polyamide prepolymer from a low molecular weight (for example, about 300 to about 15,000) polycaprolactam, polyoenantholactam, polydodecanolactam, polyundecanolactam, poly(11-aminoundecanoic acid), poly (12-aminododecanoic acid), poly(hexamethylene adipate), poly(hexamethylene azelate), poly(hexamethylene sebacate), poly(hexamethylene undecanoate), poly (hexamethylene dodecanoate), poly(nonamethylene adipate), or the like and succinic acid, adipic acid, suberic acid, azelaic acid, sebacic acid, undecanedioic acid, terephthalic acid, dodecanedioic acid, or the like. The prepolymer can then be reacted with an hydroxy-terminated polyether, for example poly(tetramethylene ether) glycol, poly (tetramethylene-co-2-methyltetramethylene ether) glycol, poly(propylene ether) glycol, poly(ethylene ether) glycol, or the like.

As noted above, the wings can be formed from any non-elastomeric, or hard, polymer. Examples of such polymers include non-elastomeric polyesters, polyamides, and polyolefins.

Useful thermoplastic non-elastomeric wing polyesters include poly(ethylene terephthalate) ("2G-T") and copolymers thereof, poly(trimethylene terephthalate) ("3G-T"), polybutylene terephthalate ("4G-T"), and poly(ethylene 2,6-naphthalate), poly(1,4-cyclohexylenedimethylene terephthalate), poly(lactide), poly(ethylene azelate), poly [ethylene-2,7-naphthalate], poly(glycolic acid), poly (ethylene succinate), poly(.alpha.,.alpha.-dimethylpropiolactone), poly(para-hydroxybenzoate), poly (ethylene oxybenzoate), poly(ethylene isophthalate), poly (tetramethylene terephthalate, poly(hexamethylene terephthalate), poly(decamethylene terephthalate), poly(1,4-cyclohexane dimethylene terephthalate) (trans), poly (ethylene 1,5-naphthalate), poly(ethylene 2,6-naphthalate), poly(1,4-cyclohexylidene dimethylene terephthalate)(cis), and poly(1,4-cyclohexylidene dimethylene terephthalate) (trans).

Preferred non-elastomeric polyesters include poly (ethylene terephthalate), poly(trimethylene terephthalate), and poly(1,4-butylene terephthalate) and copolymers thereof. When a relatively high-melting polyesters such as poly(ethylene terephthalate) is used, a comonomer can be incorporated into the polyester so that it can be spun at reduced temperatures. Such comonomers can include linear, cyclic, and branched aliphatic dicarboxylic acids having 4–12 carbon atoms (for example pentanedioic acid); aromatic dicarboxylic acids other than terephthalic acid and having 8–12 carbon atoms (for example isophthalic acid); linear, cyclic, and branched aliphatic diols having 3–8 carbon atoms (for example 1,3-propane diol, 1,2-propanediol, 1,4-butanediol, and 2,2-dimethyl-1,3-propanediol); and aliphatic and araliphatic ether glycols having 4–10 carbon atoms (for example hydroquinone bis (2-hydroxyethyl) ether). The comonomer can be present in the copolyester at a level in the range of about 0.5 to 15 mole percent. Isophthalic acid, pentanedioic acid, hexanedioic acid, 1,3-propane diol, and 1,4-butanediol are preferred comonomers for poly(ethylene terephthalate) because they are readily commercially available and inexpensive.

The wing polyester(s) can also contain minor amounts of other comonomers, provided such comonomers do not have an adverse affect on fiber properties. Such other comonomers include 5-sodium-sulfoisophthalate, for example, at a level in the range of about 0.2 to 5 mole percent. Very small amounts, for example, about 0.1 wt % to about 0.5 wt % based on total ingredients, of trifunctional comonomers, for example trimellitic acid, can be incorporated for viscosity control.

Useful thermoplastic non-elastomeric wing polyamides include poly(hexamethylene adipamide) (nylon 6,6); polycaprolactam (nylon 6); polyenanthamide (nylon 7); nylon 10; poly(12-dodecanolactam) (nylon 12); polytetramethyleneadipamide (nylon 4,6); polyhexamethylene sebacamide (nylon 6,10); poly(hexamethylene dodecanamide) (nylon 6,12); the polyamide of dodecamethylenediamine and n-dodecanedioic acid (nylon 12,12), PACM-12 polyamide derived from bis(4-aminocyclohexyl)methane and dodecanedioic acid, the copolyamide of 30% hexamethylene diammonium isophthalate and 70% hexamethylene diammonium adipate, the copolyamide of up to 30% bis-(P-amidocyclohexyl)methylene, and terephthalic acid and caprolactam, poly(4-aminobutyric acid) (nylon 4), poly(8-aminooctanoic acid) (nylon 8), poly(hapta-methylene pimelamide) (nylon 7,7), poly(octamethylene suberamide) (nylon 8,8), poly(nonamethylene azelamide) (nylon 9,9), poly(decamethylene azelamide) (nylon 10,9), poly (decamethylene sebacamide (nylon 10,10), poly[bis(4-amino-cyclohexyl)methane-1,10-decanedicarboxamide], poly(m-xylene adipamide), poly(p-xylene sebacamide), poly(2,2,2-trimethylhexamethylene pimelamide), poly (piperazine sebacamide), poly(11-amino-undecanoic acid) (nylon 11), polyhexamethylene isophthalamide, polyhexamethylene terephthalamide, and poly(9-aminononanoic acid) (nylon 9) polycaproamide. Copolyamides can also be used, for example poly(hexamethylene-co-2-methylpentamethylene adipamide) in which the hexamethylene moiety can be present at about 75–90 mol % of total diamine-derived moieties.

Useful polyolefins include polypropylene, polyethylene, polymethylpentane and copolymers and terpolymers of one or more of ethylene or propylene with other unsaturated monomers. For example, fibers comprising non-elastomeric polypropylene wings and an elastomeric polypropylene core are within the scope of the present invention; such fibers are bicomponent fibers.

Combinations of elastomeric and non-elastomeric polymers can include a polyetheramide, for example, a polyetheresteramide, elastomer core with polyamide wings and a polyetherester elastomer core with polyester wings. For example a wing polymer can comprise nylon 6-6, and copolymers thereof, for example, poly(hexamethylene-co-2-methylpentamethylene adipamide) in which the hexamethylene moiety is present at about 80 mol % optionally mixed with about 1% up to about 15% by weight of nylon-12, and a core polymer can comprise an elastomeric segmented polyetheresteramide. "Segmented polyetheresteramide" means a polymer having soft segments (long-chain polyether) covalently bound (by the ester groups) to hard segments (short-chain polyamides). Similar definitions correspond to segmented polyetherester, segmented polyurethane, and the like. The nylon 12 can improve the wing adhesion to the core, especially when the core is based on PEBAX™ 3533SN from Atofina. Another preferred wing polymer can comprise a non-elastomeric polyester selected from the group of poly(ethylene terephthalate) and copolymers thereof, poly(trimethylene terephthalate), and poly (tetramethylene terephthalate); an elastomeric core suitable for use therewith can comprise a polyetherester comprising the reaction product of a polyether glycol selected from the group of poly(tetramethyleneether) glycol and poly (tetramethylene-co-2-methyl-tetramethyleneether) glycol with terephthalic acid or dimethyl terephthalate and a low molecular weight diol selected from the group of 1,3-propane diol and 1,4-butane diol.

An elastomeric polyetherester core can also be used with non-elastomeric polyamide wings, especially when an adhesion-promoting additive is used, as described elsewhere herein. For example, the wings of such a fiber can be selected from the group of (a) poly(hexamethylene adipamide) and copolymers thereof with 2-methylpentamethylene diamine and (b) polycaprolactam, and the core of such a fiber can be selected from the group of (a) polyetheresteramide and (b) the reaction products of poly(tetramethyleneether) glycol or poly(tetramethylene-co-2-methyltetramethyleneether) glycol with terphthalic acid or dimethyl terephthalate and a diol selected from the group of 1,3-propane diol and 1,4-butene diol.

Methods of making the polymers described above are known in the art and may include the use of catalysts, co-catalysts, and chain-branchers, as known in the art.

The high elasticity of the core permits it to absorb compressional and extensional forces as it is twisted by the attached wings when the fiber is stretched and relaxed. These forces can cause delamination of the two polymers if their attachment is too weak. The present invention optionally uses a mechanical locking of the wing and core polymers to enhance the attachment, and further minimize delamination, upon fiber processing and use. Bonding between the core and wings can be even further enhanced by selection of the wing and core compositions and/or the use of adhesion-promoting additives to either or both polymers. An adhesion promoter can be used in each or only some of the wings. Thus, individual wings can have different degrees of lamination to the core, e.g., some of the wings can be made to intentionally delaminate. One example of such additive is nylon 12, e.g., 5% by weight, based on total wing polymer, i.e., poly(12-dodecanolactam), also known as "12"or "N12", commercially available as Rilsan® "AMNO" from Atofina. Also, maleic anhydride derivatives (for example Bynel® CXA, a registered trademark of E.I. du Pont de Nemours and Company or Lotader® ethylene/acrylic ester/maleic anhydride terpolymers from Atofina) can be used to modify a polyether-amide elastomer to improve it adhesion to a polyamide.

As another example, a thermoplastic novolac resin, for example HRJ12700 (Schenectady International), having a number average molecular weight in the range of about 400 to about 5000, could be added to an elastomeric (co) polyetherester core to improve its adhesion to (co)polyamide wings. The amount of novolac resin should be in the range of 1–20 wt %, with a more preferred range of 2–10 wt %. Examples of the novolac resins useful herein include, but are not limited to, phenol-formaldehyde, resorcinol-formaldehyde, p-butylphenol-formaldehyde, p-ethylphenol-formaldehyde, p-hexylphenol-formaldehyde, p-propylphenol-formaldehyde, p-pentylphenol-formaldehyde, p-octylphenol-formaldehyde, p-heptylphenol-formaldehyde, p-nonylphenol-formaldehyde, bisphenol-A-formaldehyde, hydroxynapthaleneformaldehyde and alkyl- (such as t-butyl-) phenol modified ester (such as penterythritol ester) of rosin (particularly partially maleated rosin). See allowed U.S. patent application Ser. No. 09/384,605, filed Aug. 27, 1999 for examples of techniques to provide improved adhesion between copolyester elastomers and polyamide.

Polyesters functionalized with maleic anhydride ("MA") could also be used as adhesion-promoting additives. For, example, poly(butylene terephthalate) ("PBT") can be functionalized with MA by free radical grafting in a twin screw extruder, according to J. M. Bhattacharya, *Polymer International* (August, 2000), 49: 8, pp. 860–866, who also reported that a few weight percent of the resulting PBT-g-MA was used as a compatibilizer for binary blends of poly(butylene terephthalate) with nylon 66 and poly (ethylene terephthalate) with nylon 66. For example, such an additive could be used to adhere more firmly (co)polyamide wings to a (co)polyetherester core of the fiber of the present invention.

The polymers and resultant fibers, yarns, and articles used in the present invention can comprise conventional additives, which are added during the polymerization process or to the formed polymer or article, and may contribute towards improving the polymer or fiber properties. Examples of these additives include antistatics, antioxidants, antimicrobials, flameproofing agents, dyestuffs, light stabilizers, polymerization catalysts and auxiliaries, adhesion promoters, delustrants, such as titanium dioxide, matting agents, and organic phosphates.

Other additives that may be applied on the fibers, for example, during spinning and/or drawing processes include antistatics, slickening agents, adhesion promoters, hydrophilic agents antioxidants, antimicrobials, flameproofing agents, lubricants, and combinations thereof. Moreover, such additional additives may be added during various steps of the process as is known in the art.

While the above description focuses on advantages when the fiber has a substantially radially symmetric cross-section, such symmetry, while often desired, is not required for embodiments of the invention where:

(a) the stretchable synthetic polymer fiber has a delamination rating of less than about 1 and an after boil-off shrinkage of at least about 20%.

(b) the stretchable synthetic polymer fiber has at least about 20% after boil-off shrinkage and requires less than about 10% stretch to substantially straighten the fiber;

(c) the stretchable synthetic polymer fiber comprises an axial core comprising an elastomeric polymer and a plurality of wings comprising a non-elastomeric polymer attached to the core, wherein the core includes on its outside surface a sheath of a non-elastomeric polymer between points where the wings contact the core;

(d) the stretchable synthetic polymer fiber comprises an axial core comprising an elastomeric polymer and a plurality of wings comprising a non-elastomeric polymer attached to the core, wherein the core has a substantially circular or regular polyhedron cross section; or (e) the stretchable synthetic polymer fiber comprises an axial core comprising an elastomeric polymer and a plurality of wings comprising a non-elastomeric polymer attached to the core, wherein at least one of the wings has a T, C, or S shape.

The fibers of the invention can be in the form of continuous filament (either a multifilament yarn or a monofilament) or staple (including for example tow or spun yarn). The drawn fibers of the invention can have a denier per fiber of from about 1.5 to about 60 (about 1.7–67 dtex). Fully drawn fibers of the invention with polyamide wing typically have tenacities of about 1.5 to 3.0 g/dtex, and fibers with polyester wing, about 1–2.5 g/dtex, depending on wing/core ratios.

The final fiber can have at least about 20% after boil-off stretch. For greater stretch and recovery in fabrics made from the fibers of the invention, the fibers can have an after boil-off stretch of at least about 45%.

When a yarn comprising a plurality of fibers is made, the fibers can be of any desired fiber count and any desired dpf, and the ratios of the elastomeric to non-elastomeric polymers can differ from fiber to fiber. The multifilament yarn can contain a plurality of different fibers, for example, from 2 to 100 fibers. In addition, yarns comprising the fibers of the present invention can have a range of linear densities per fiber and can also comprise fibers not of the invention.

The synthetic polymer fibers of the present invention may be used to form fabrics by known means including by weaving, warp knitting, weft (including circular) knitting, or hosiery knitting. Such fabrics have excellent stretch and power of recovery. The fibers can be useful in textiles and fabrics, such as in upholstery, and garments (including lingerie and hosiery) to form all or a portion of the garment, including narrows. Apparel, such as hoisiery, and fabrics made using the fibers and yarns of the present invention have been found to be smooth, lightweight, and very uniform ("non-picky") with good stretch and recovery properties.

Figure 7:
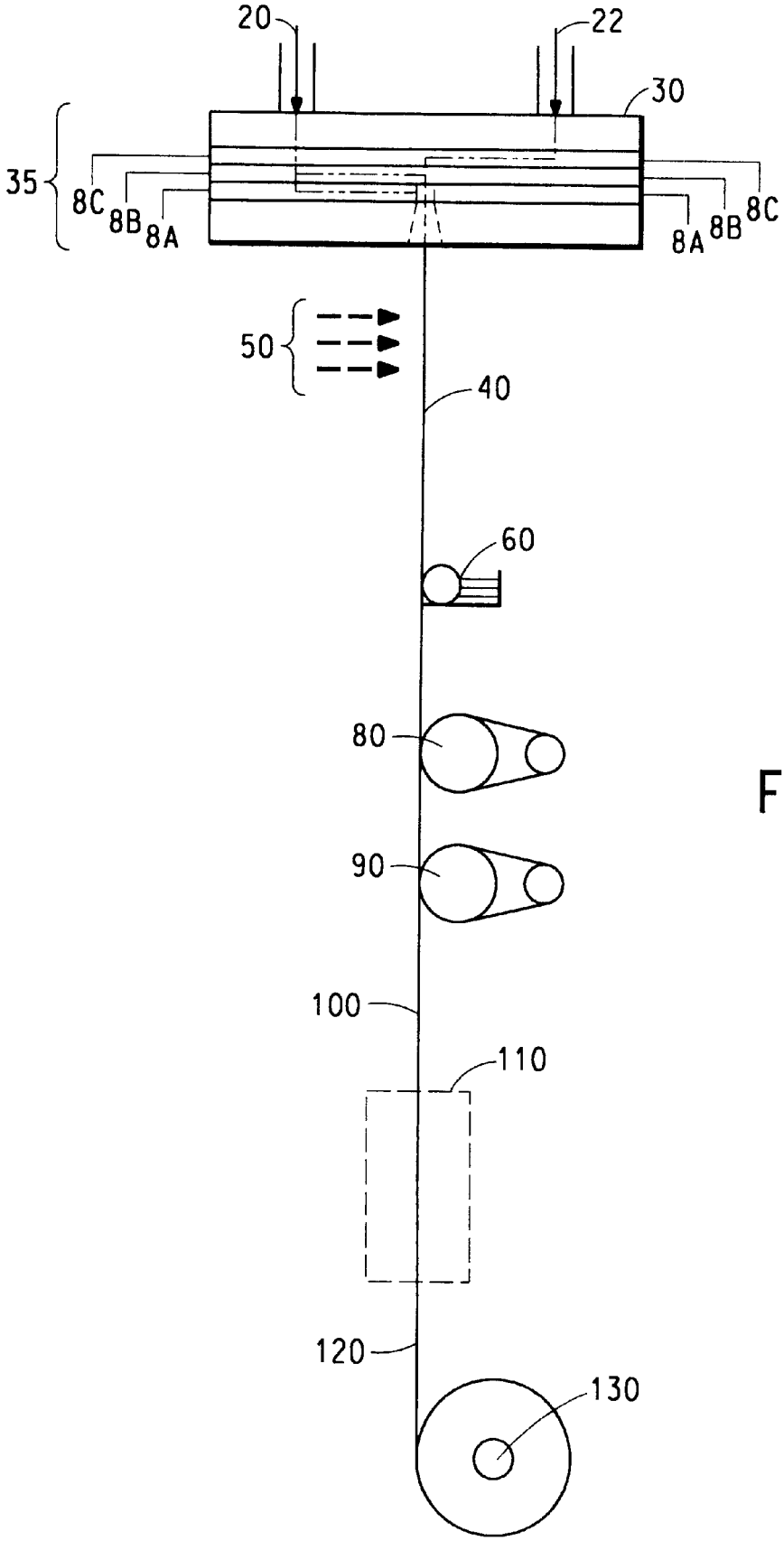
FIG. 7 is process schematic apparatus useful for making fibers of this invention.

Further in accordance with the present invention, there is provided a melt spinning process for spinning continuous polymer fibers. This process will be described with respect to FIG. 7, which is a schematic of an apparatus which can be used to make the fibers of the present invention. However, it should be understood that other apparatus may be used. The process of the present invention comprises passing a melt comprising an elastomeric polymer through a spinneret to form a plurality of stretchable synthetic polymeric fibers including an axial core comprising the elastomeric polymer and a plurality of wings attached to the core and comprising the non-elastomeric polymer. With reference to FIG. 7, a thermoplastic hard polymer supply, which is not shown, is introduced at 20 to a stacked plate spinneret assembly 35, and a thermoplastic elastomeric polymer supply, which is not shown, is introduced at 22 to spin pack assembly 30. Precoalescence or post coalescence spinneret packs can be used. The two polymers can be extruded as undrawn filaments 40 from stacked plate spinneret assembly 35 having orifices designed to give the desired cross section. The process of the present invention further includes quenching the filaments after they exit the capillary of the spinneret to cool the fibers in any known manner, for example by cool air at 50 in FIG. 7. Any suitable quenching method may be used, such as cross-flow air or radially flowing air.

The filaments are optionally treated with a finish, such as silicone oil optionally with magnesium stearate using any known technique at a finish applicator 60 as shown in FIG. 7. These filaments are then drawn, after quenching, so that they exhibit at least about 20% after boil-off stretch. The filaments may be drawn in at least one drawing step, for example between a feed roll 80 (which can be operated at 150 to 1000 meters/minute) and a draw roll 90 shown schematically in FIG. 7 to form a drawn filament 100. The drawing step can be coupled with spinning to make a fully-drawn yarn or, if a partially oriented yarn is desired, in a split process in which there is a delay between spinning and drawing. Drawing can also be accomplished during winding the filaments as a warp of yarns; called "draw warping" by those skilled in the art. Any desired draw ratio, (short of that which interferes with processing by breaking filament) can be imparted to the filament, for example, a fully oriented yarn can be produced by a draw ratio of about 3.0 to 4.5 times, and a partially oriented yarn produced by a draw ratio of about 1.2–3.0 times. Herein, draw ratio is the draw roll 90 peripheral speed divided by the feed roll 80 peripheral speed. Drawing can be carried out at about 15–100° C., typically about 15–40° C.

The drawn filament 100 optionally can be partly relaxed, for example, with steam at 110 in FIG. 7. Any amount of heat-relaxation can be carried out during spinning. The greater the relaxation, the more elastic the filament, and the less shrinkage that occurs in downstream operations. The drawn, final filament, after being relaxed as described below, can have at least about 20% after boil-off stretch. It is preferred to heat-relax the just-spun filament by about 1–35% based on the length of the drawn filaments before winding it up, so that it can be handled as a typical hard yarn.

The quenched, drawn, and optionally relaxed filaments can then be collected by winding at a speed of 200 to about 3500 meters per minute and up to 4000 meters per minute, at winder 130 in FIG. 7. Or if multiple fibers have been spun and quenched, the fibers can be converged, optionally interlaced, and then wound up for example at up to 4000 meters per minute at winder 130, for example in the range of about 200 to about 3500 meters per minute. Single filament or multifilament yams may be wound up at winder 130 in FIG. 7, in the same manner. Where multiple filaments have been spun and quenched, the filaments can be converged and oprtionally interlaced prior to winding as is done in the art.

At any time after being drawn, the biconstituent filament may be dry- or wet-heattreated while fully relaxed to develop the desired stretch and recovery properties. Such relaxation can be accomplished during filament production, for example during the above-described relaxation step, or after the filament has been incorporated into a yarn or a fabric, for example during scouring, dyeing, and the like. Heat-treatment in fiber or yarn form can be carried out using hot rolls or a hot chest or in a jet-screen bulking step, for example. It is preferred that such relaxed heat-treatment be performed after the fiber is in a yarn or a fabric so that up to that time it can be processed like a non-elastomeric fiber; however, if desired, it can be heat-treated and fully relaxed before being wound up as a high-stretch fiber. For greater uniformity in the final fabric, the fiber can be uniformly heat-treated and relaxed. The heat-treating/relaxation temperature can be in the range of about 80° C. to about 120° C. when the heating medium is dry air, about 75° C. to about 100° C. when the heating medium is hot water, and about 101° C. to about 115° C. when the heating medium is superatmospheric pressure steam (for example in an autoclave). Lower temperatures can result in too little or no heat-treatment, and higher temperatures can melt the elastomeric core polymer. The heat-treating/relaxation step can generally be accomplished in a few seconds.

As noted above, the spinneret capillary has a design corresponding to the desired cross-section of the fibers of the present invention, as described above, or to produce other biconstituent or bicomponent fibers. The capillaries or spinneret bore holes may be cut by any suitable method, such as by laser cutting, as described in U.S. Pat. No. 5,168,143, drilling, Electrical Discharge Machining (EDM), and punching, as is known in the art. The capillary orifice can be cut using a laser beam for good control of the cross-sectional symmetry of the fiber of the invention. The orifices of the spinneret capillary can have any suitable dimensions and can be cut to be continuous (pre-coalescence) or non-continuous (post-coalescence). A non-continuous capillary may be obtained by boring small holes in a pattern that would allow the polymer to coalesce below the spinneret face and form the multi-wing cross-section of the present invention.

Figure 8:
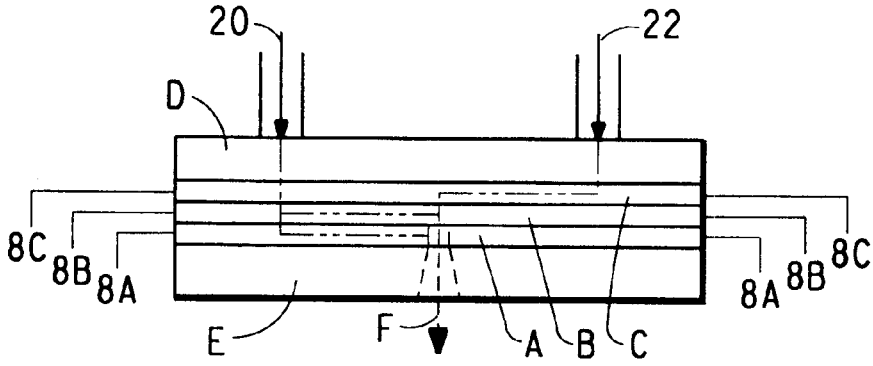
FIG. 8 is a representation of a stacked plate spinneret assembly, in side elevation, that can be used to make the fiber of the invention.

For example, the filaments of the invention can be made with a precoalescence spinneret pack as illustrated in FIGS. 8, 8A, 8B and 8C. In FIG. 8, a side elevation of the stacked plate spinneret assembly as shown in FIG. 7, the polymer flow is in the direction of arrow F. The first plate in the spinneret assembly is plate D containing the polymer melt pool and is of a conventional design. Plate D rests upon metering plate C (shown in cross sectional view FIG. 8C), which in turn rests upon optional distribution plate B (shown in cross sectional view FIG. 8B), which rests on spinneret plate A (shown in cross sectional view FIG. 8A), which is supported by spinneret assembly support plate E. Metering plate C is aligned and in contact with distribution plate B below the metering plate, the distribution plate being above, aligned with, and in contact with spinneret plate A having capillaries there through but lacking substantial counterbores, the spinneret plate(s) being aligned and in contact with a spinneret support plate (E) having holes larger than the capillaries. The alignments are such that a polymer fed to the metering plate C can pass through distribution plate B, spinneret plate A and spinneret support plate E to form a fiber. Melt pool plate D, which is a conventional plate, is used to feed the metering plate. The polymer melt pool plate D and spinneret assembly support plate E are sufficiently thick and rigid that they can be pressed firmly toward each other, thus preventing polymer from leaking between the stacked plates of the spinneret assembly. Plates A, B, and C are sufficiently thin that the orifices can be cut with laser light methods. It is preferred that the holes in the spinneret support plate (E) be flared, for example at about 45°–60°, so that the just-spun fiber does not contact the edges of the holes. It is also preferred that, when precoalescence of the polymers is desired, the polymers be in contact with each other (precoalescence) for less than about 0.30 cm, generally less than 0.15 cm, before the fiber is formed so that the cross-sectional shape intended by the metering plate C, optional distribution plate D, and spinneret plate design E is more accurately exhibited in the fiber. More precise definition of the fiber cross-section can also be aided by cutting the holes through the plates as described in U.S. Pat. No. 5,168,143, in which a multi-mode beam from a solid-state laser is reduced to a predominantly single-mode beam (for example $TM_{00}$ mode) and focused to a spot of less than 100 microns in diameter and 0.2 to 0.3 mm above the sheet of metal. The resulting molten metal is expelled from the lower surface of the metal sheet by a pressurized fluid flowing coaxially with the laser beam. The distance from the top of the uppermost distribution plate to the spinneret face can be reduced to less than about 0.30 cm.

Figure 8A:
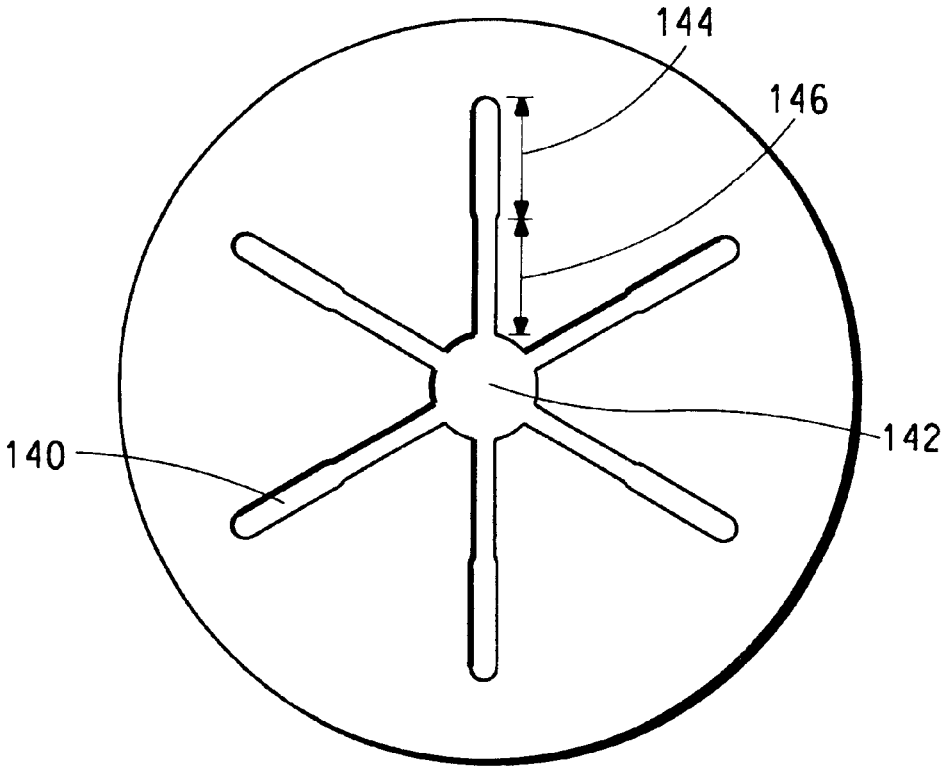
FIG. 8A is a representation of orifice plate A in plan view at 90° to the stacked plate spinneret assembly shown in FIG. 8 and taken across lines 8A—8A of FIG. 8.
Figure 8B:
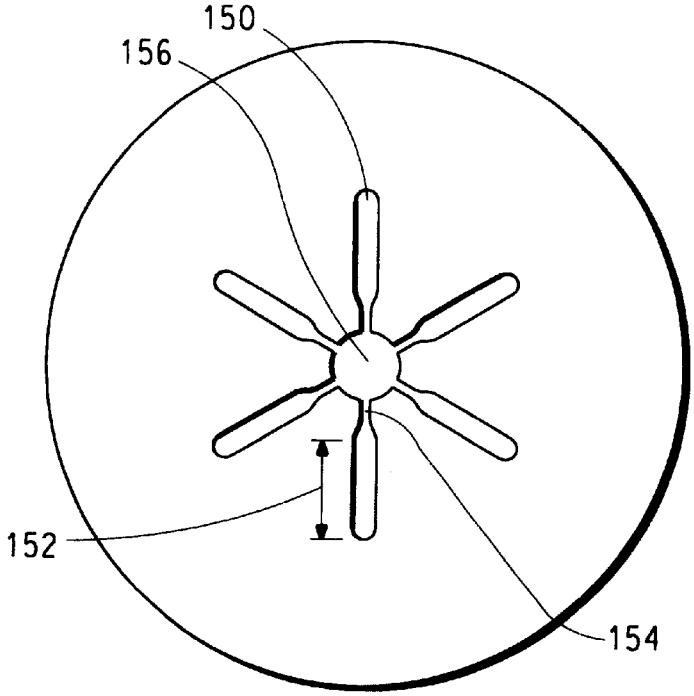
FIG. 8B is a representation of an orificie plate B in plan view at 90° to the stacked plate spinneret assembly shown in FIG. 8 and taken across lines 8B—8B of FIG. 8.
Figure 8C:
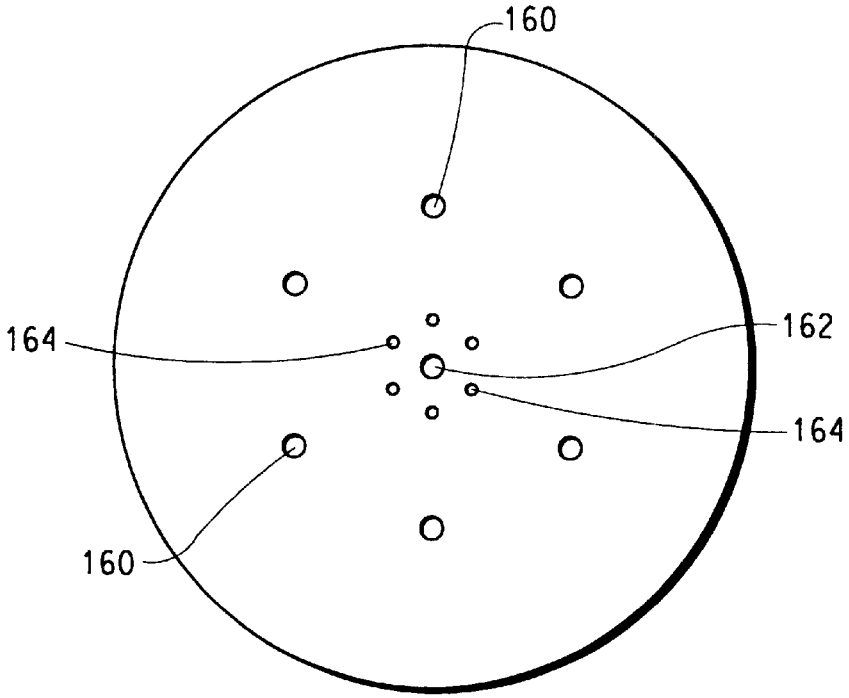
FIG. 8C is a representation of orifice plate C in plan view at 90° to the stacked plate spinneret assembly shown in FIG. 8 and taken across lines 8C—8C of FIG. 8.

To make filaments having any number of symmetrically placed wing polymer portions, the same number of symmetrically arranged orifices are used in each of the plates. For example in FIG. 8A, spinneret plate A is shown in a plan view oriented 90° to the stacked plate spinneret assembly of FIG. 7. Plate A in FIG. 8A is comprised of six symmetrically arranged wing spinneret orifices 140 connected to a central round spinneret hole 142. Each of the wing orifices 140 can have different widths 144 and 146. Shown in FIG. 8B is the complementary distribution plate B having distribution orifices 150 tapering at an open end 152 to optional slot 154 connecting the distribution orifices to central round hole 156. Shown in FIG. 8C is metering plate C with metering capillaries 160 for the wing polymer and a central metering capillary 162 for the core polymer. Polymer melt pool plate D can be of any conventional design in the art. Spinneret support plate E has a through hole large enough and flared away (for example at 45–60°) from the path of the newly spun filament so that the filament does not touch the sides of the hole, as is shown in FIGS. 7 and 8 side elevation. The stacked plate spinneret assembly, plates A through D, are aligned so that core polymer flows from polymer melt pool plate D through central metering hole 162 of metering plate C and through the 6 small capillaries 164, through central circular capillary 156 of distribution plate B, through central circular capillary 142 of spinneret assembly plate A, and out through large flared hole in spinneret support plate E. At the same time, wing polymer flows from polymer melt pool plate D through wing polymer metering capillaries 160 of metering plate C, through distribution orifices 150 of distribution plate B (in which, if optional slot 154 is present, the two polymers first make contact with each other), through wing polymer orifices 140 of spinneret plate A, and finally out through the hole in spinneret assembly support plate E.

Figure 9A:
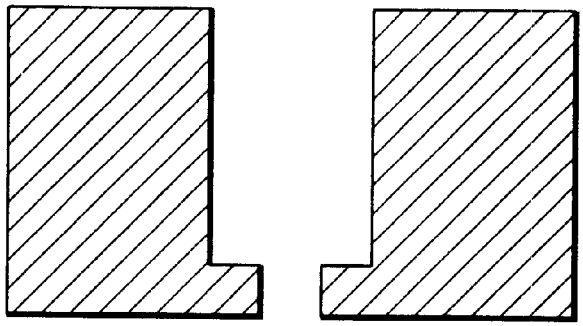
FIG. 9A (PRIOR ART)
FIGS. 9A–9C show in cross-sectional cut-away a representation two spinneret plates of the invention.
Figure 9B:
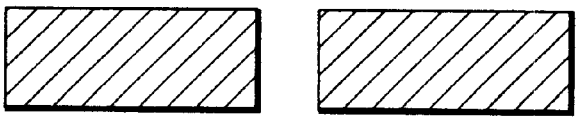
Figure 9C:
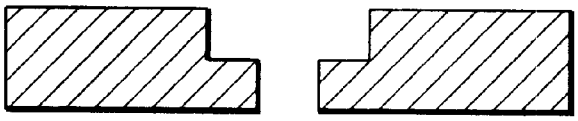

The spinneret pack of the invention can be used for the melt extrusion of a plurality of synthetic polymers to produce a fiber. In the spinneret pack of the present invention, the polymers can be fed directly into the spinneret capillaries, since the spinneret plate does not have a substantial counterbore. By no substantial counterbore is meant that the length of any counterbore present (including any recess connecting the entrances of a plurality of capillaries) is less than about 60%, and preferably less than about 40%, of the length of the spinneret capillary. See FIG. 9A, which shows a cross-sectional of a spinneret plate of the prior art and FIGS. 9B and C, which shows a cross-section of spinneret plates of the present invention. Directly metering multicomponent polymer streams into specific points at the backside entrance of the fiber forming orifice in the spinneret plate eliminates problems in polymer migration when multiple polymer streams are combined in feed channels substantially before the spinneret orifice, as is the norm.

It can be useful to combine the functions of two plates into one through the use of recessed grooves, on one or both sides of the single plate with appropriate holes through the plate to connect the grooves. For example, recesses, grooves and depressions can be cut in the upstream side of the spinneret plate (for example by electrodischarge machining) and can function as distribution channels or shallow, insubstantial counterbores.

A variety of fibers comprising two or more polymers can be made with the spinneret pack of the present invention. For example, other biconstituent fibers and bicomponent fibers not disclosed and/or claimed herein can be so made, including the cross-sections disclosed in U.S. Pat. Nos. 4,861,660, 3,458,390, and 3,671,379. The resulting fiber cross-section can be for example side-by-side, eccentric sheath-core, concentric sheath-core, wing-and-core, wing-and-sheath-and core, and the like. Moreover, the spinneret pack of the invention can be used to spin splittable or non-splittable fibers.

Figure 10:
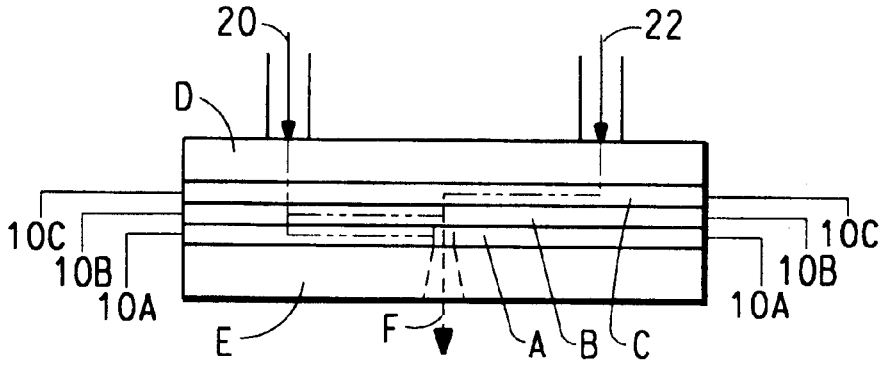
FIG. 10 is a representation of a stacked plate spinneret assembly, in side elevation, that can be used to make alternative embodiment fiber of the invention.
Figure 10A:
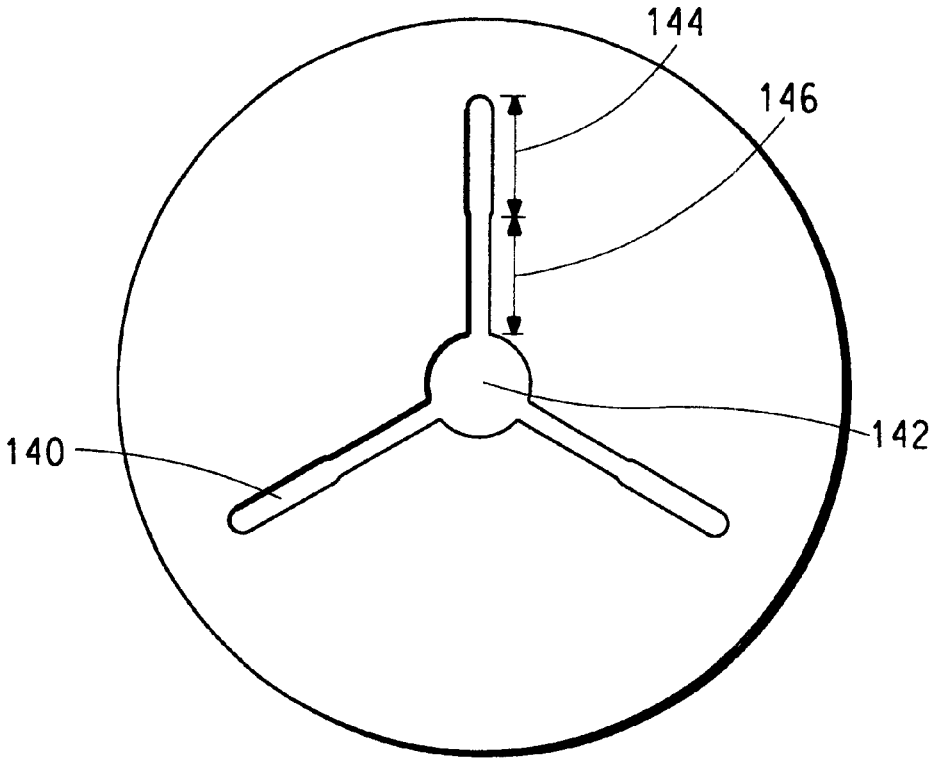
FIGS. 10A, 10B and 10C show respectively, an alternative embodiment of a spinneret plate, distribution plate, and metering plate, in plan view at 90° to the stacked plate spinneret assembly of FIG. 10, each of which can be used in a spinneret pack assembly of the invention to make an alternative embodiment fiber of the invention.
Figure 10B:
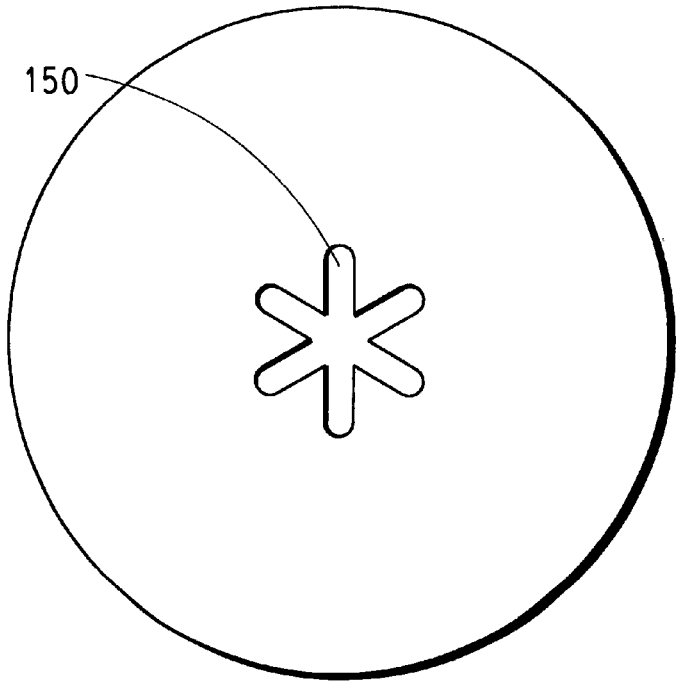
Figure 10C:
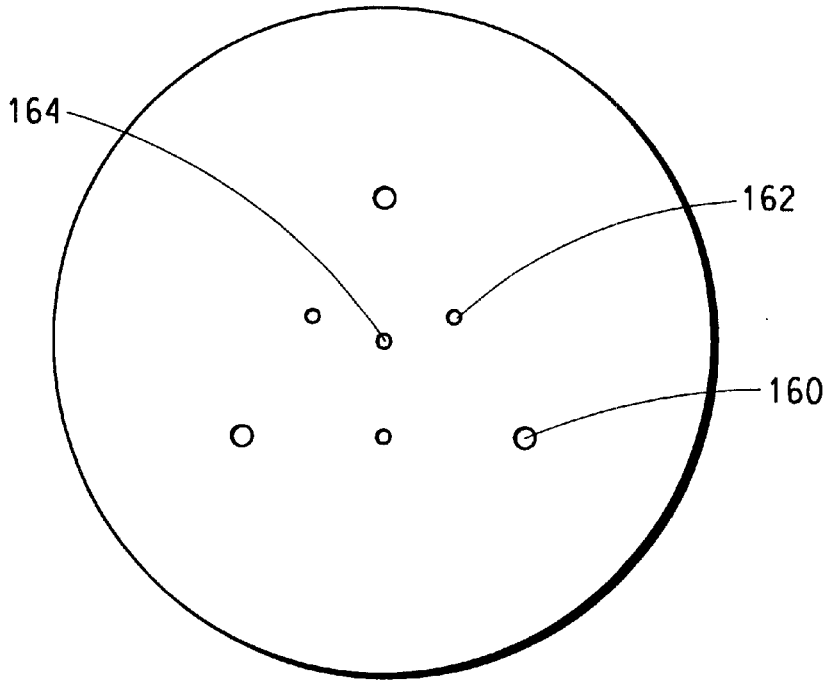

The spinneret pack of the invention can be modified to achieve different multiwinged fibers, for example, by changing the number of capillary legs for a different desired wing count, changing slot dimensions to change the geometric parameters as needed for production of a different denier per filament or yarn count, or as desired for use with various synthetic polymers. For example, in the embodiment of FIG. 10 is shown a relatively thin spinneret pack used to make a fiber with three wings, as exemplied in Example 7 below. In FIG. 10A., the spinneret plate was 0.015 inches (0.038 cm) thick and had orifices machined through the full thickness of stainless steel, by the laser light methods herein disclosed, in the form of three straight wings 140 each of two widths (having lengths 144 and 146 respectively) and arranged symmetrically at 120 degrees apart around a center of symmetry; there was no counterbore above the capillary orifice. Each wing 140 was 0.040 inches (0.102 cm) long from its tip to the circumference of a central round spinneret hole 142 of 0.012 inches (0.030 cm) diameter whose center coincided with the center of symmetry. Referring next to FIG. 10B, distribution plate B, of 0.010 inch (0.025 cm) thickness, was coaxially aligned over spinneret plate A so that every other wing orifice 150 of distribution plate B was aligned with a wing 140 of spinneret plate A; each wing orifice 150 of distribution plate B was 0.1375 inches (0.349 cm) long from its tip to the center of symmetry. Metering plate C (FIG. 10C) was 0.010 (0.025 cm) inches thick and had holes 160 of 0.025 inch (0.064 cm) diameter, holes 162 of 0.015 inch (0.038 cm) diameter, and central hole 164 of 0.010 inch (0.025 cm) diameter. Plate C was aligned with distribution plate B so that, in use, wing polymer fed by melt pool plate D (see FIG. 10) to holes 160 and core polymer fed to holes 162 and 164 of distribution plate C were distributed by plate B to plate A to form a fiber, in which the wings penetrated the core. There was no counterbore in spinneret plate A, and the combined thickness of plates A, B, and C was only about 0.035 inches (0.089 cm).

Figure 11A:
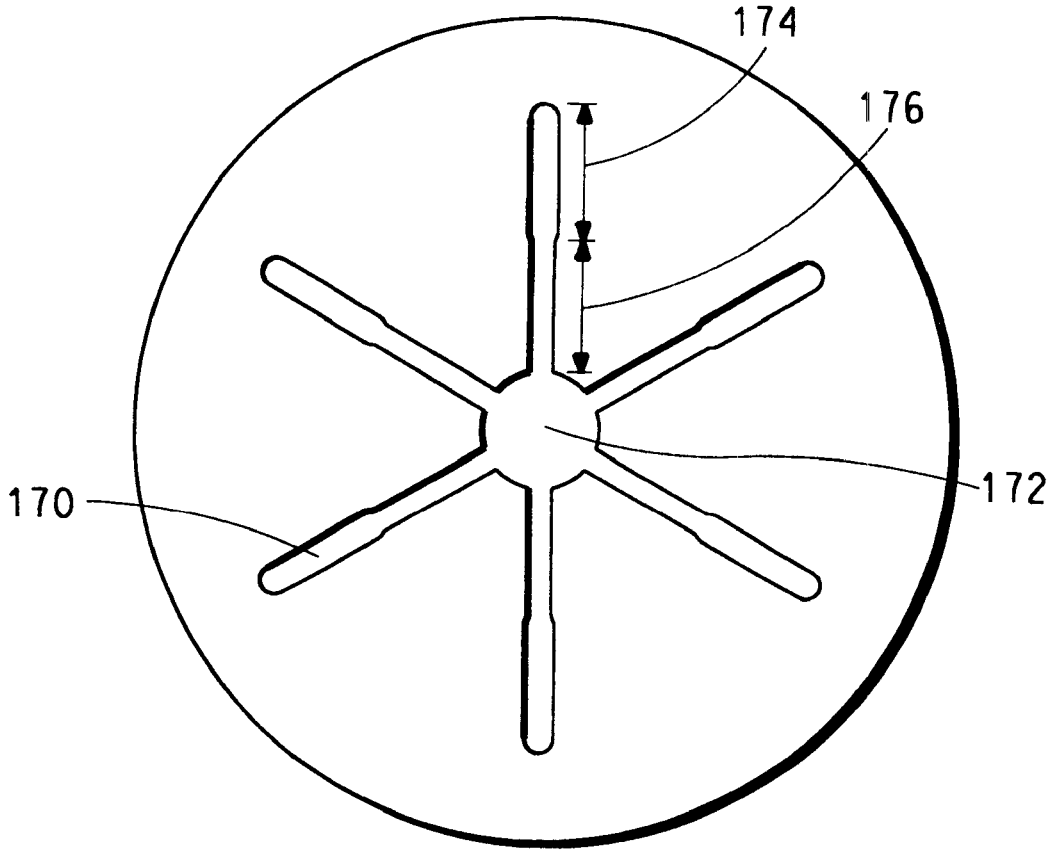
FIGS. 11A, 11B, and 11C show respectively, another alternative embodiment of a spinneret plate, distribution plate, and metering plate, in plan view at 90° to the stacked plate spinneret assembly of FIG. 10, each of which can be used in a spinneret pack assembly of the invention to make an alternative embodiment fiber of the invention.
Figure 11B:
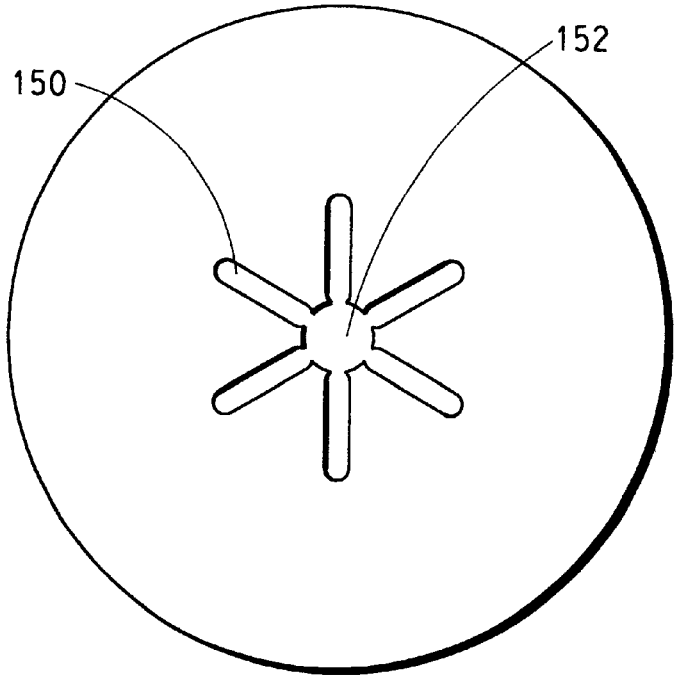
Figure 11C:
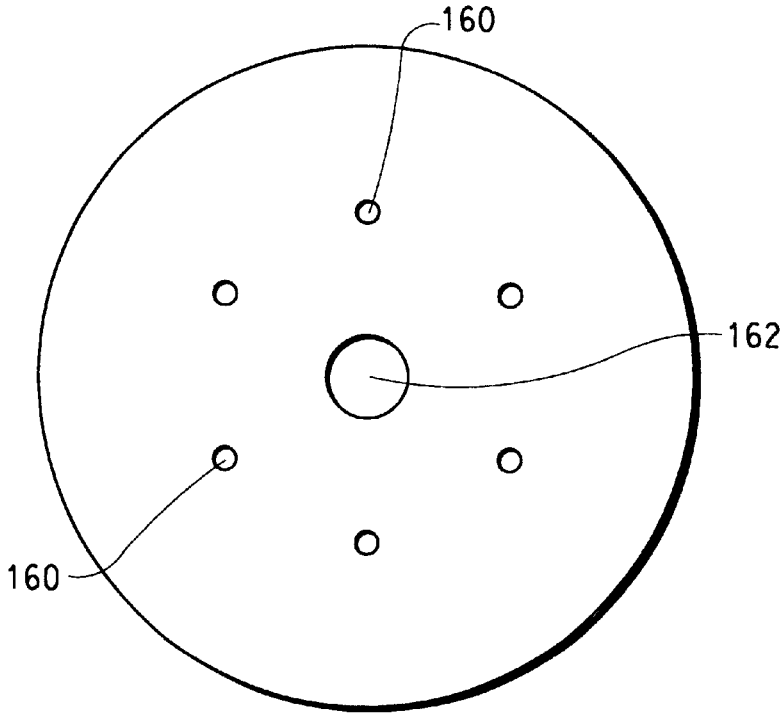
Figure 12:
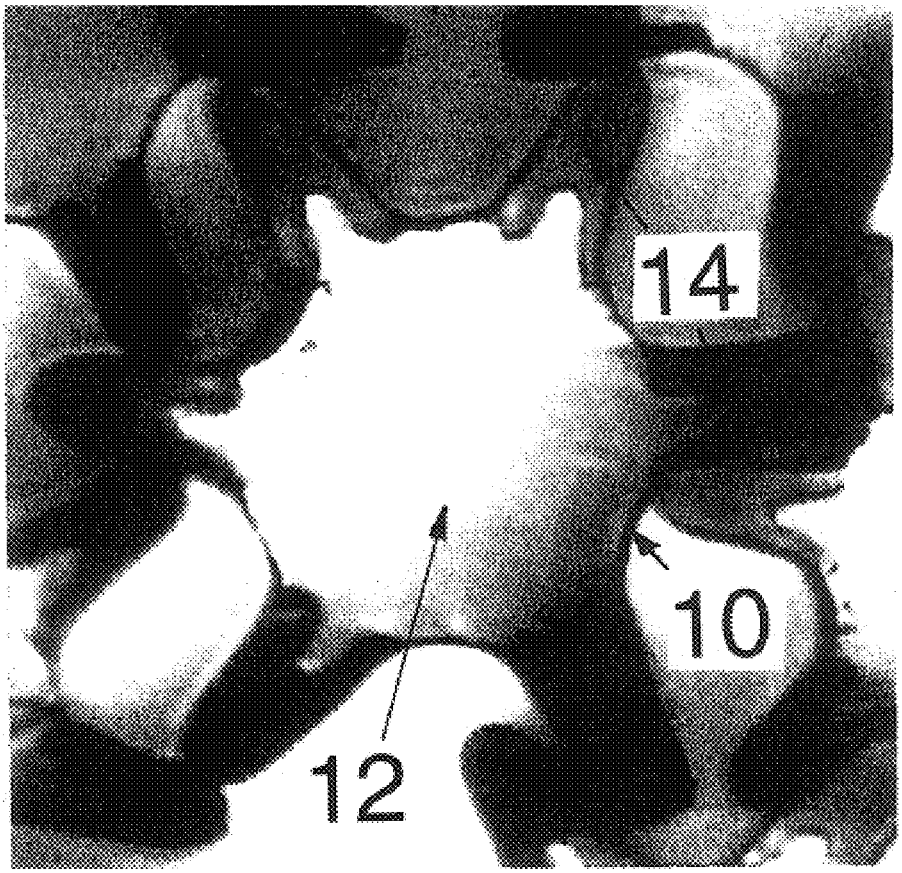
FIG. 12 is a cross-sectional representation of the fiber of the invention as exemplified in Example 6.

In another spinneret pack assembly embodiment, no spinneret support plate E (see FIG. 8) was used. This is exemplified in Example 8 below. In FIG. 11A., spinneret plate A was 0.3125 inch (0.794 cm) thick, and each spinning orifice had an 0.100 inch (0.254 cm) diameter counterbore and an 0.015 inch (0.038 cm) long capillary at the bottom of the counterbore. As shown in FIG. 11A, each spinneret orifice in spinneret plate A had six straight wing orifices 170, each of which had a long axis centerline which passed through a center of symmetry and had a length of 0.035 inch (0.089 cm) from its tip to the circumference of central round hole 172. Length 174 from the tip of each wing to 0.015 inch (0.038 cm) was 0.004 inch (0.010 cm) wide; length 176 was 0.020 inch (0.051 cm) long and 0.0028 inch (0.007 cm) wide. The tip of each wing was radius-cut at one-half the width of the tip. Distribution plate B (see FIG. 11B) was 0.015 inch (0.038 cm) thick and had six-wing orifices, each of which was centered above a corresponding counterbore in spinneret plate A and oriented so that each wing orifice in plate B was aligned with a wing orifice of plate A. Each wing orifice 150 in plate B was 0.060 inch (0.152 cm) long and 0.020 inch (0.051 cm) wide, and its tip was rounded to a radius of 0.010 inch (0.025 cm). Central hole 152 in plate B was 0.100 inch (0.254 cm) in diameter. Metering plate C (see FIG. 11C) was also 0.015 inch (0.038 cm) thick. In plate C, holes 160 had a diameter of 0.008 inch (0.020 cm) and were 0.100 inch (0.254 cm) from the center of central hole 162, which of plates B and A and formed the core of the fiber. Non-elastomeric wing polymer was fed to holes 160 in plate C and passed through the wing orifices of plates B and A to form the wings of the fiber. Wing and core polymers first make contact at the top of distribution plate B, which is 0.328 inch (0.833 cm) above the face of spinneret plate A from which the fiber is extruded was 0.080 inch (0.203 cm) in diameter. Plate C was aligned with plate B so that the six holes 160 of plate C were above the centerlines of the wing orifices 150 of plate B. The plates were aligned so that elastomeric core polymer fed to hole 162 of plate C passed through the center.

The invention is illustrated by the following non-limiting examples. The following test methods were used.

TEST METHODS

The term after boil-off stretch is used interchangeably in the art with the following terms: "% stretch", "recoverable stretch", "recoverable shrinkage" and "crimp potential". The term "non-recoverable shrinkage" is used interchangeably with the following terms: "% shrinkage", "apparent shrinkage" and "absolute shrinkage".

Stretch properties (after boil-off stretch, after boil-off shrinkage and stretch recovery after boil-off) of the fibers prepared in Example 1.A, B, C, and D were determined as follows. A 5000 denier (5550 dtex) skein was wound on a 54 inch (137 cm) reel. Both sides of the looped skein were included in the total denier. Initial skein lengths with a 2 gram weight (length CB) and with a 1000 gram weight (0.2 g/denier) (length LB) were measured. The skein was subjected to 30 minutes in 95° C. water ("boil off"), and initial (after boil off) lengths with a 2 gram weight (length $CA_{initial}$) and with a 1000 gram weight (length $LA_{initial}$) were measured. After measurement with the 1000 gram weight, additional lengths were measured with a 2 gram weight after 30 seconds (length $CA_{30sec}$) and after 2 hours (length $CA_{2hrs}$). Shrinkage after boil-off was calculated as 100×(LB−LA)/LB. Percent after boil-off stretch was calculated as 100×(LA−CA@30 sec)/CA@30 sec. Recovery after boil-off was calculated as $100\times(LA-CA_{2hrs})/(LA-CA_{initial})$.

The test for unload force at 20% and 35% available stretch was performed as follows. A biconstituent fiber skein having a total denier of 5000 (5550 dtex) after boil off was prepared. Both sides of the looped skein were included in the total denier. An Instron tensile tester (Canton, Mass.) was used at 21° C. and 65% relative humidity. The skein was placed in the tester jaws, between which there was a 3 inch (76 mm) gap. The tester was cycled through three stretch-and-relax (load-and-unload) cycles, each load cycle having a maximum of 500 grams force (0.2 grams per denier), and then the force on the $3^{rd}$ unload cycle was determined. An effective denier (that is, the actual linear density at the test elongation) was determined for 20% and 35% available stretch on the $3^{rd}$ unload cycle. "20% and 35% available stretch" means that the skein had been relaxed 20% and 35%, respectively, from the 500 gram force on the $3^{rd}$ cycle. The unload force at 20% and 35% available stretch was recorded in milligrams per effective denier (mg/denier).

Delamination of the wings from the core of a fiber was determined by first winding a 5000 denier (5550 dtex) skein (the skein size included both sides of the resulting loop) on a 1.25 meter reel. The skein was subjected to 102° C. steam in an autoclave for 30 minutes. A 20 cm length individual fiber was selected from the skein and folded once in half. The open end of the resulting loop was taped together at the bottom, and the taped loop was hung vertically on a hook. A weight of 1 gram per denier (50 grams for a 25 denier loop) was attached to the bottom (taped) end of the loop. The weight was raised to the point at which the loop was slack, and then lowered gently to stretch the loop and apply the full weight. After 10 such cycles the loop was examined for delamination under magnification and rated. Three samples were rated as follows:

0=No wing/core delamination visable along the fiber

1=Slight delamination observed at one or more of the node reversals

2=Delamination observed where the fiber rubbed against the hook from which it was hanging 3=Marginal delamination (in small loops, and only in a few spots)

4=Small loops indicating delamination along the entire fiber

5=Gross delamination (large loops all along the fiber)

The results from the three samples were averaged.

$R_1$ and $R_2$ were measured by superimposing two circles on a photomicrograph of a cross-section of the fiber so that one circle ($R_1$) circumscribed the approximate outermost extent of the core polymer and the other circle ($R_2$) inscribed the approximate innermost extent of the wing polymer.

EXAMPLES

Example 1

Each drawn fiber had a linear density of 26 denier (28.6 dtex) and as substantially radially symmetrical. After-boil-off properties are reported in Table 1.

Example 1.A

Comparison

Biconstituent fibers were spun using an apparatus as illustrated in FIG. 7 and the stacked plate spinneret assembly in FIG. 8. A first polymer, which formed the cores of the fibers, was introduced at 20 to spin filter pack 30 in FIG. 7. The core polymer was a polyetheresteramide (PEBAX™ 3533SN, from Atofina) and was metered volumetrically to create a core which was 51 wt % of each fiber. At 22 in FIG. 7 a melted nylon copolymer was introduced to spin filter pack 30. The nylon copolymer which formed the six wings was poly(hexamethylene-co-2-methylpentamethylene adipamide) in which the hexamethylene moiety was present at 80 mol % of diamine-derived moieties. There was no significant penetration of the wing by the core or vice versa ($R_1/R_2$=1.09).

Precoalescence spinneret pack assembly was comprised of stacked plates labeled A through E and shown in FIG. 8 in side elevation. Orifices were cut through 0.015 inch (0.038 cm) thick stainless steel spinneret plate A as six wings arranged symmetrically at 60°, around a center of symmetry using a process as described in U.S. Pat. No. 5,168,143. As illustrated in FIG. 8A, each wing orifice 140 was straight with a long axis centerline passing through the center of symmetry and had a length of 0.049 inches (0.124 cm) from tip to the circumference of a central round spinneret hole 142 (diameter 0.012 inches [0.030 cm]) with origin of radius the same as the center of symmetry. There was no counterbore at the entrance to the spinneret capillary. The wing length 144 from tip to 0.027 inches (0.069 cm) was 0.0042 inches (0.0107 cm) wide; the remaining length 146 of 0.022 inches (0.056 cm) was 0.0032 inches (0.0081 cm) wide. The tip of each wing was radius-cut at one-half the width of the tip. Distribution plate B (FIG. 8B) of 0.015 inches (0.038 cm) thickness was aligned with the spinneret plate A (FIG. 8A.) so that its distribution orifices were congruent with the spinneret orifices in the spinneret plate A. The six wing orifices 150 of plate B were 0.094 inch (0.239 cm) long and 0.020 inch (0.051 cm) wide, and their wing tips were rounded to a radius one-half their width. As illustrated in FIG. 8B, each of the six wing orifices 150 of distribution plate B tapered to a rounded (0.006 inch (0.015 cm diameter) open end and then continued as a slot 154 of 0.013 inch (0.033 cm) length and 0.0018 inch (0.0046 cm) length to central hole 156. The central hole 156 in this plate was 0.0125 inches (0.032 cm) in diameter. A slot 154 connected the central hole with the end of each wing distribution orifice. Metering plate C was of 0.010 inch (0.025 cm) thickness (see FIG. 8C). Each of the metering holes was centered above a wing long axis centerline or above the center of symmetry in distribution plate B. The central metering hole 162 and one hole per wing 160 were 0.010 inch (0.025 cm) diameter; the centers of holes 160 were 0.120 inch (0.305 cm) from the center of hole 162. The central metering hole was fed filtered melted elastomeric polymer from a conventional melt pool plate D (see FIG. 7) and formed the core element within the final fiber. The outer six metering holes 160 of plate C were fed a non-elastomeric polymer from melt pool plate D to become the polymer wings. Large holes (typically 0.1875 inches (0.4763 cm) in diameter) in spinneret support plate E (see again FIG. 8) were aligned with the spinneret orifices in spinneret plate A and were flared at 45°. Spinneret plate A, distribution plate B, and metering plate C were sandwiched by melt pool plate D and spinneret support plate E; as shown in FIG. 8. Typically, plate E was 0.2–0.5 inches (0.4–1.3 cm) thick, and plate D was 0.02–0.03 inches (0.05–0.08 cm) thick.

Thus, there was no counterbore in the spinneret plate A, and the combined thickness of plates A, B, and C was only about 0.040 inches (0.102 cm). The wing and core polymers first came into contact with each other just above distribution plate B, so that they were precoalesced with each other for about 0.076 cm (0.038 cm distribution plate +0.038 spinneret plate) before the fiber was formed.

Freshly spun fiber 40 (see FIG. 7) was cooled to solidify it by a flow of air 50, and 5 wt % (based on fiber weight) of a finish comprising silicone oil and a metal stearate was applied at 60. The fiber was forwarded to a draw zone between feed roll 80 and draw roll 90, taking several wraps about each roll. The speed of draw roll 90 was four (4) times that of feed roll 80, (the latter was 350 meters per minute) for a draw ratio of 4.0. The filament was then treated with steam at 6 pounds per square inch (0.87 kilopascal) in a chamber 110; winder 130 was operated at a speed 20% lower than that of draw roll pair 90 so that the fiber was partly (20%) relaxed in order to reduce shrinkage in the final fiber. The drawn and partly relaxed fiber 120 was wound up at winder 130 and had a linear density of 26 denier (29 dtex).

Example 1.B

Comparison

A fiber having six wings of poly(hexamethylene-co-2-methylpentamethylene adipamide) in which the hexamethylene moiety was present at 80 mol % and a core of PEBAX™ 3533SN was spun substantially as in Example 1.A, except that 5 wt % based on the total wing polymer nylon 12 [poly(dodecanolactam), "N12"] (Rilsan® AMNO from Atofina), based on total wing polymer weight, was added to the wing polymer to aid in wing-to-core cohesion. The wing/core weight ratio was 48/52, and $R_1/R_2$ was 1.05.

Example 1.C

Invention

A fiber having six wings of poly(hexamethylene-co-2-methylpentamethylene adipamide) (20mol % 2-methylpentamethylene moieties, based on diamine-derived moieties) and a PEBAX™ 3533SN core (flex modulus 2800 psi (19,300 kPascals) was prepared substantially as in Example 1.A, except that metering plate C had another-set of holes 164 (as shown in FIG. 8C), one per wing on the centerline of the wing, each hole 0.005 inches (0.013 cm) in diameter and 0.0475 inches (0.121 cm) from the center of symmetry of the holes. These additional holes and the central hole were fed melted polymer from a common melt pool to form the core and the protruding core elements within the wings. As a result, there was wing penetration by the core polymer ($R_1/R_2$=1.6, estimated from the ratio of a similarly prepared fiber), to better adhere the wings to the core. The fiber cross section was substantially as illustrated by FIG. 2.

Example 1.D

Invention

A fiber was spun substantially as in Example 1.C, but with 5% by weight nylon 12 [poly(dodecanolactam)] (Rilsan® AMNO) cohesion additive in the wings. The fibers had wing portion penetration by the core polymer ($R_1/R_2$=1.5 ), better to adhere the wings to the core. The fiber cross section was substantially as illustrated by FIG. 2.

TABLE 1

| | Example 1.A (comparative) | Example 1.B (comparative) | Example 1.C (invention) | Example 1.C (invention) |
|---|---|---|---|---|
| $R_1/R_2$ | 1.1 | 1.1 | 1.6 | 1.5 |
| Wing polymer | 6/MPMD(80/20)-6 | 6/MPMD(80/20)-6 + 5 wt % N12 | 6/MPMD(80/20)-6 | 6/MPMD(80/20)-6 + 5 wt % N12 |
| Core polymer | PEBAX ™ 3533SN | PEBAX ™ 3533SN | PEBAX ™ 3533SN | PEBAX ™ 35335N |
| % after boil-off stretch | 67 | 92 | 103 | 70 |
| % shrinkage after boil off | 31 | 19 | 22 | 21 |
| Delamination rating | 3.8 | 1.2 | 0.2 | 0.0 |

These data show the fibers to be very good for hosiery and apparel applications. The superior performance of the fibers with wings adhered to the core is revealed by the delamination data. Fibers of the invention can have a delamination rating of less than about 1.0. In addition, the data show that use of an adhesion additive such as N12 in the wing polymer is advantageous.

Example 2.A

A three-filament biconstituent yarn of the invention was spun substantially as in Example 1.D, with the following differences. Each plate had five holes for wing polymer arranged symmetrically at 72° apart so that each fiber had five wings. The polymer in the five wings was 95 wt % polycaprolactam (3.14 IV, conventionally prepared by, and obtained from, DuPont do Brasil) with 5 wt % nylon 12 additive. The wing/core ratio was varied as shown in Table 2.A. The finish was a mixture of coconut oil, quaternary amine, water, and nonionic surfactant, applied at 2 wt % based on fiber. The feed roll speed was 420 meters per minute, and the drawn fiber was subjected to 15% relaxation before winding it up. The cross-section was substantially as shown in FIG. 2; $R_1/R_2$ was about 1.4, and the drawn fiber was 23 denier (25 dtex).

The percent after boil-off stretch for yarns of varying wing core ratio was determined as before.

TABLE 2.A

| Wing to core ratio (WEIGHT RATIO) | Percent after boil-off stretch |
|---|---|
| 35.5/67.5 | 127 |
| 35.0/65.0 | 148 |
| 40.0/60.0 | 100 |
| 42.5/57.5 | 91 |
| 45.0/55.0 | 85 |
| 47.5/52.5 | 80 |
| 50.0/50.0 | 79 |

TABLE 2.A-continued

| Wing to core ratio (WEIGHT RATIO) | Percent after boil-off stretch |
|---|---|
| 52.5/47.5 | 69 |
| 55.0/45.0 | 58 |

The results in Table 2.A show that higher after boil-off stretch is attained when the wing/core weight ratio is less than about 50/50 in the fiber of the Example, which is preferred when no companion fiber is used with the fiber of the invention. Even lower wing/core ratios are often preferred (for example about 20/80 to about 40/60) when companion fibers are used with the fiber of the invention to increase the recovery force in the combination yarn.

Example 2.B

Hosiery durability, sheerness and stretch were assessed as a function of the total linear density (denier, decitex) of the wings. The fibers from Example 2.A were knitted into hosiery. No other fiber was used. The total denier of the fiber and wing-to-core volume ratio were varied. A panel of reviewers subjectively rated the hosiery for a) durability on the basis of wear life, b) sheerness aesthetic (versus a reference standard of hosiery similarly knit from 10 denier LYCRA™ spandex covered with 7 denier (8 dtex) nylon 6-6 of 5 fibers), and c) percent after boil-off stretch. Durability was rated acceptable if it exceeded 7 days; sheerness was rated acceptable if it was equal to the reference standard; and percent stretch was rated acceptable if it was between 40 and 120% and prevented bagginess and "ride-down" of the hosiery. The starred (*) and bolded numbers in Table 2.B indicate the decitex and wing-to-core ratios qualitatively preferred on the basis of the three rating areas. The numbers in the body of the Table are the summed decitex of the wings of each fiber.

TABLE 2.B

| Total Dtex | Wing/core Wt. ratio 35/65 | Wing/core Wt. ratio 40/60 | Wing/core Wt. Ratio 45/55 | Wing/core Wt. ratio 50/50 | Wing/core Wt. ratio 55/45 | Wing/core Wt. ratio 60/40 |
|---|---|---|---|---|---|---|
| 17 | 5.8 | 6.7 | 7.5 | 8.3 | 9.2 | 10.0 |
| 22 | 7.8 | 8.9 | 10.0 | 11.0* | 12.2 | 13.3 |
| 28 | 9.7 | 11* | 12.5* | 13.9* | 15.3 | 16.6 |
| 33 | 11.7* | 13.3* | 15.0* | 16.6* | 18.3 | 20.0 |

As the total decitex was increased above about 33, the sheerness of the hosiery was reduced. As the total decitex was reduced below about 22 and summed wing decitex fell below about 11, durability began to suffer. As the wing/core weight ratios rose above about 50/50, percent stretch began to drop (as earlier shown in Example 2.A).

As a result of this test, it was concluded that a preferred biconstituent fiber of the invention can have a total linear density in the range of about 22 to 33 dtex, a wing portion summed decitex of at least about 11 and a wing to core weight ratio of between 35/65 and 50/50.

Example 3A

A biconstituent fiber of the invention was spun substantially as described in Example 2A, except that 4 wt % (based on weight of fiber) of a polysiloxane-based finish (as described in U.S. Pat. No. 4,999,120) was applied in place of the finish of Example 2A, the fiber was relaxed 20% before being wound up, and the steam used during the relaxation step was at 3 psi (20.7 kilopascal). The wing/core/protruding-core weight ratio was 38/53/9, and $R_1/R_2$ was about 1.4. FIG. 5 is a cross-section photomicrograph of the fiber, which was 32 denier (36 dtex, as-drawn) and had 108% after boil-off stretch, 24% shrinkage after boil-off, and 92% recovery after boil-off.

Example 3.B

Hosiery blanks were knit from the fiber of Example 3.A on a commercial machine typically set up for every course mechanically double covered spandex leg constructions. The machine was a MATEC HSE 4.5, knitting at about 700 RPM in the thigh area and 800 RPM in the ankle and was set up as size F. One leg blank was knit in about two minutes. The leg yarns were fed to the machine in the normal manner for hard yarns; no electronic tensioners were used. The greige hose blanks were finished by tumble steaming at atmospheric pressure for 30 minutes. The garments were then boarded using standard industry automated autoclave boarding equipment for four seconds at 102° C., followed by drying at 95° C. for 30 seconds. Fabric length for boarding was chosen to be as small as possible while holding the fabric in a wrinkle free state. The garments were dyed using standard acid dyes at 98° C. for 45 minutes and postboarded using the same dimension board and condition.

The resulting fabric had an unexpectedly high thermal conductivity of $3.38\times10^{-4}$ watts/cm-° C.

Example 4

Three-filament biconstituent yarns according to the invention were prepared with polyester wings and polyetherester cores using an apparatus as depicted in FIG. 7. The core polymer of fiber 4.A. was HYTREL® 3078 polyetherester elastomer (a registered trademark of E.I. du Pont de Nemours and Company; flex modulus 4000 psi (27,600 kPascals). The core polymer for fibers of Example 4.B and Example 4.C was a polyetherester elastomer having a poly (tetramethylene-co-2-methyltetramethylene ether) glycol soft segment and butylene terephthalate (4G-T) hard segment, prepared substantially as described in U.S. Pat. No. 4,906,721. The amount of 3-methyltetrahydrofuran incorporated into the copolyether glycol was 9 mol %, the glycol number average molecular weight was 2750, and the mole ratio of 4G-T to copolyether glycol was 4.6:1. In Table 4, this polymer is designated as "2MePO4G:4G-T". The wing polymer in fibers of Examples 4A and 4B was poly(butylene terephthalate) (4G-T, Crastin® 6129; a registered trademark of E.I. du Pont de Nemours and Company; 350,000 psi flex modulus (2.4 million kPascals)), and in fiber 4.c. it was poly(trimethylene terephthalate) (3G-T). The 3G-T was prepared from 1,3-propanediol and dimethylterephthalate in a two-vessel process using tetraisopropyl titanate catalyst, Tyzor® TPT (a registered trademark of E.I. du Pont de Nemours and Company) at 60 ppm, based on polymer. Molten DMT was added to 3G and catalyst at 185° C. in a transesterification vessel, and the temperature was increased to 210° C. while methanol was removed. The resulting intermediate was transferred to a polycondensation vessel where the pressure was reduced to one millibar (10.2 kg/cm$^2$), and the temperature was increased to 255° C. When the desired melt viscosity was reached, the pressure was increased and the polymer was extruded, cooled, and cut into pellets. The pellets were further polymerized in the solid-phase to an intrinsic viscosity of 1.04 dl/g in a tumble dryer operated at 212° C. The spinneret pack and spinning conditions for each of the fibers of this Example were substantially the same as in Example 2A, except that there was no polymer additive in the wings, the wings were 40 wt % of the total fiber, 4 wt % (based on fiber) of the finish described in Example 3A was applied, and the fiber was relaxed 20% before being wound up with the aid of steam at 3 pounds per square inch pressure (20.7 kilopascal). The fibers had the properties reported in Table 4.

TABLE 4

| | Example 4A | Example 4B | Example 4C |
|---|---|---|---|
| Denier (dtex) | 25 (27.5 dtex) | 24 (26 dtex) | 27 (30 dtex) |
| Wing polymer | 4G-T | 4G-T | 3G-T |
| Core polymer | HYTREL ™ 3078 | 2MePO4G:4G-T | 2MePO4G:4G-T |
| $R_1/R_2$ | 1.6 | 1.6 | 1.6 |
| % after boil-off stretch | 60 | 100 | 76 |
| % shrinkage after boil off | 10 | 12 | 12 |
| % recovery after boil off | 85 | 94 | 89 |
| Unload force @ 20% Available Stretch | 15 | 18 | 17 |
| Unload force @ 35% Available Stretch | 3 | 5 | 1 |

The delamination rating for the fiber of Example 4B was 0.0. Sheer hosiery blanks knit from fibers of Examples 4A, 4B and 4C, after steam boarding, dyeing, and finishing, had uniform appearance and good stretch and recovery.

Example 5.A

A biconstituent fiber according to the invention was spun with the polymers and finish of Example 1D using the apparatus of FIG. 7 and the spinneret pack and spinning conditions of Example 3A, except that 13 wt % finish was used, based on weight of fiber. The wing and core polymers first were in contact with each other for about 0.076 cm before being spun into fibers.

The core penetrated the wing so that the wing/core/protruding-core weight ratio was 39/51/10 ($R_1/R_2$ was about 1.5). The fiber had a linear density of 20 denier (22 dtex), a percent after boil-off stretch of 100%, an after-boil-off shrinkage of 23%, and recovery after boil-off of 94%.

Example 5.B

Four ends of the fiber of Example 5.A were air-jet intermingled to form a biconstituent yarn. A fabric was woven on a SULZER RUTI 5100 (air jet loom) in a 3/1 construction using the air-jet intermingled biconstituent yarn as the weft at 38 yarns per cm (96 picks/inch) and 44 denier (48 dtex)/34 filament TACTEL™ (a registered trademark of E.I. du Pont de Nemours and Company) Type 6342 nylon as the warp at 48 warp ends per cm (121 per inch). The woven fabric was finished by steam relaxing it at 115° C., MCF jet scouring at 70° C.; MCF jet dyeing at 100° C. for 60 minutes using standard acid dyes for nylon; and heat setting at 190° C. for 30 seconds. These fabrics were non-bulky and smooth without wrinkles upon air drying, and they showed good stretch and recovery and excellent hard fiber hand and visual aesthetics. The relaxed finished woven fabric had the following properties:

| | | |
|---|---|---|
| Basis weight = | 3.29 oz/sq yd | (112 grams/m$^2$) |
| Thickness = | 0.079 inch | (2 mm) |
| Fill Count = | 160/inch | (63/cm) |
| Warp Count = | 208/inch | (82/cm) |

A 5 cm width×10 cm length of fabric could be stretched 40% by hand after which it recovered by more than 95%.

Example 6

Figure 3:
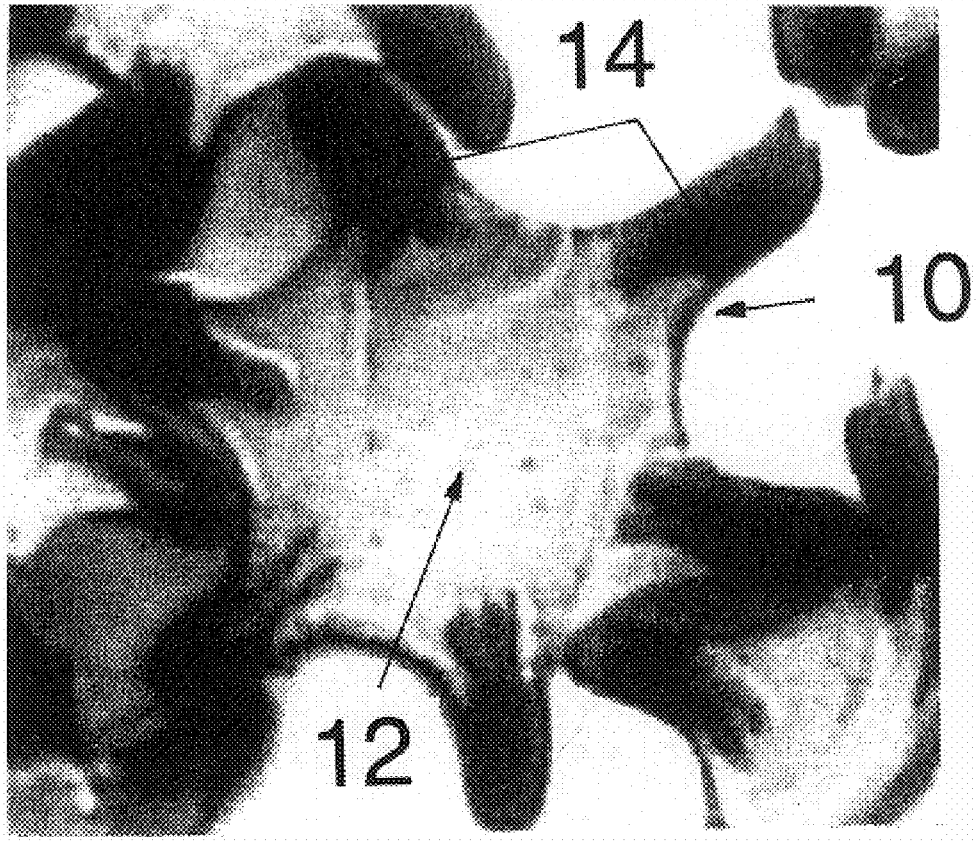
FIG. 3 is a cross-sectional representation of an embodiment of the fiber of the invention, where the protruding polymer, for example the wing polymer, protrudes into the penetrated polymer, for example the core polymer, like the roots of a tooth.

This example illustrates the use of a full thickness spinneret to make the fiber of the invention. The same precoalescence spinneret pack was used as in Example 1C, except that support plate E was replaced by a spinneret (FIG. 11A) of 0.3125 inch (0.794 cm) thickness having a spinneret capillary (0.015 inch (0.038 cm) length) of the same pattern, size, axial registry, and radial orientation as the orifice in spinneret plate A (FIG. 8A) and a 0.1406 inch (0.357 cm) diameter round counterbore. The wing and the core polymer were first in contact with each other for about 0.87 cm (0.794 cm spinneret+0.038 cm plate A+0.038 cm plate B) before the fiber was formed. A 25 denier (28 dtex) biconstituent fiber having six wings of poly(hexamethylene-co-2-methylpentamethylene adipamide) in which the hexamethylene moiety was present at 80 mol % of diamine-derived moieties (conventionally prepared; Relative Viscosity of 90) and a core of PEBAX 3533SN polyetheresteramide was spun using the apparatus of FIG. 7 with a 4× draw ratio and was wound up at 1400 meters per minute. The wing/core/protruding-core weight ratio was 45/48/7, and $R_1/R_2$ was about 1.4. In the fiber thus spun the core penetrated into the wing, but without the often preferred reduced neck section, as shown in FIG. 3.

Example 7

Figure 13:
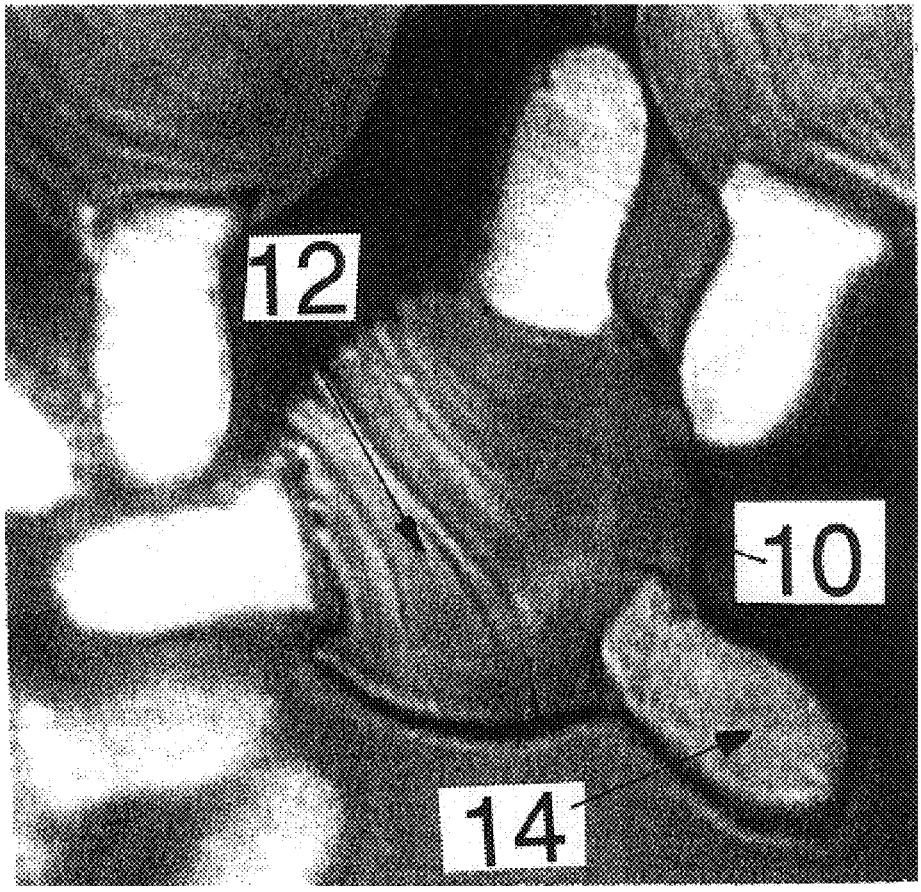
FIG. 13 is a cross-sectional representation of the fiber of the invention as exemplified in Example 7.

This example illustrates a biconstituent fiber having three wings in which the wings penetrate the core and also illustrates the use of a thin spinneret pack to make the fiber. The wing polymer was poly(hexamethylene dodecanamide) (Intrinsic Viscosity 1.18, Zytel® 158, a registered trademark of E.I. du Pont de Nemours and Company), and the core polymer was PEBAX® 3533SA polyetheresteramide. A ten filament yarn of 70 denier (78 dtex) was spun with a 40/60 volume ratio of the wing to core at a spinneret temperature of 265° C. A precoalescence spinneret pack as generally shown in FIG. 10 was used, but with individual plates different from those in previous Examples. Stainless steel spinneret plate A, shown in FIG. 1A, was 0.015 inches (0.038 cm) thick and had orifices cut through it by a method of Example 1A, in the form of three straight wings 1 each of two widths and arranged symmetrically at 120° apart around a center of symmetry; there was no counterbore above the capillary orifice. Each wing 140 was 0.040 inches (0.102 cm) long (length 144 plus length 146 in FIG. 10A.) from its tip to the circumference of a central round spinneret hole 142 of 0.012 inches (0.030 cm) diameter whose center coincided with the center of symmetry. Referring next to FIG. 10B, distribution plate B, of 0.010 inch (0.025 cm) thickness, was coaxially aligned over spinneret plate A so that every other wing orifice 150 of distribution plate B was aligned with a wing 140 of spinneret plate A; each wing orifice 150 of distribution plate B was 0.1375 inches (0.349 cm) long from its tip to the center of symmetry. Metering plate C (FIG. 10C) was 0.010 (0.025 cm) inches thick and had holes 160 of 0.025 inch (0.064 m) diameter, holes 162 of 0.015 inch (0.03 cm) diameter, and central hole 164 of 0.010 inch (0.025 m) diameter. Plate C was aligned with distribution plate B so that, in use, wing polymer fed by melt pool plate D (see briefly FIG. 10) to holes 160 and core polymer fed to holes 162 and 164 of distribution plate C were distributed by plate B to plate A to form a filament, in which the wings penetrated the core. There was no counterbore in spinneret plate A, and the combined thickness of plates A, B, and C was only about 0.035 inches (0.089 cm). The yarn was drawn 3.5× at a draw roll speed of 1225 meters/minute and relaxed in an atmospheric pressure steam jet to a windup speed of 1045 meters/minute. The yarn developed a spiral twist when steamed in a relaxed state and had high stretch and recovery. A photomicrograph of the cross-section of a fiber made according to this Example is shown in FIG. 13.

Example 8

This Example illustrates the use of a spinneret plate of conventional thickness in making the fiber of the invention.

Example 1.A was repeated with the following differences. No spinneret support plate E was used (see FIG. 8). Spinneret plate A was 0.3125 inch (0.794 cm) thick, and each spinning orifice had an 0.100 inch (0.254 cm) diameter counterbore and an 0.015 inch [(0.038 cm) long capillary at the bottom of the counterbore. As shown in FIG. 11A, each spinneret orifice in spinneret plate A had six straight wing orifices 170, each of which had a long axis centerline which passed through a center of symmetry and had a length of 0.035 inch (0.089 cm) from its tip to the circumference of central round hole 172. Length 174 from the tip of each wing to 0.015 inch (0.038 cm) was 0.004 inch (0.010 cm) wide; length 176 was 0.020 inch (0.051 cm) long and 0.0028 inch (0.007 cm) wide. The tip of each wing was radius-cut at one-half the width of the tip. Distribution plate B (see FIG. 11B) was 0.015 inch (0.038 cm) thick and had six-wing orifices 150, each of which was centered above a corresponding counterbore in spinneret plate A and oriented so that each wing orifice 150 in plate B was aligned with a wing orifice 170 of plate A. Each wing orifice 150 in plate B was 0.060 inch (0.152 cm) long and 0.020 inch (0.051 cm) wide, and its tip was rounded to a radius of 0.010 inch (0.025 cm). A central hole 152 in plate B was 0.100 inch (0.254 cm) in diameter. Metering plate C (see FIG. 11C) was also 0.015 inch (0.038 cm) thick. In plate C, holes 160 had a diameter of 0.008 inch (0.020 cm) and were 0.100 inch (0.254 cm) from the center of central hole 162, which was 0.080 inch (0.203 cm) in diameter. Plate C was aligned with plate B so that the six holes 160 of plate C were above the centerlines of the wing orifices 150 of plate B. The plates were aligned so that elastomeric core polymer fed to hole 162 of plate C passed through the center of plates B and A and formed the core of the fiber. Non-elastomeric wing polymer was fed to holes 160 in plate C and passed through the wing orifices of plates B and A to form the wings of the fiber. Wing and core polymers first make contact at the top of distribution plate B, which is 0.328 inch (0.833 cm) above the face of spinneret plate A from which the fiber is extruded.

The spinneret temperature was 247° C. A yarn of 14 filaments was spun, 5 wt % of a polyetherester-based finish was applied in place of the previously used finish, and the yarn was relaxed 15% (based on drawn yarn length) before being wound up. The drawn and partly relaxed yarn had a linear density of 75 denier (83 decitex), and $R_1/R_2$ was 1.20. A photomicrograph of the cross-section of the fiber is shown in FIG. 6.

While the invention has been described in conjunction with the detailed description thereof, it is to be understood that the foregoing description is exemplary and explanatory in nature, and is intended to illustrate the invention and its preferred embodiments. Through routine experimentation, the artisan will recognize apparent modifications and variations that may be made without departing from the spirit of the invention.

What is claimed is:

1. A stretchable synthetic polymer fiber including an axial core comprising a thermoplastic elastomeric polymer and a plurality of wings attached to the core and comprising a thermoplastic, non-elastomeric polymer, wherein at least one of the wing polymer or core polymer protrudes into the other polymer.

2. The fiber of claim 1, wherein said core contains an outer radius $R_1$, an inner radius $R_2$, and $R_1/R_2$ is greater than about 1.2.

3. The fiber of claim 2, wherein $R_1/R_2$ is in the range of about 1.3 to about 2.0, the weight ratio of non-elastomeric wing polymer to elastomeric core polymer is in the range of about 10/90 to about 70/30, and the after boil-off stretch is at least about 20%.

4. The fiber of claim 1, wherein the protruding polymer includes a remote enlarged end section and a reduced neck section joining the end section to the remainder of the protruding polymer to form at least one necked-down portion therein.

5. The fiber of claim 1, wherein the wings are of substantially the same dimensions and are substantially symmetrically arranged about the axial core.

6. A fiber of claim 1, wherein the non-elastomeric polymer is selected from the group consisting of polyamides, non-elastomeric polyolefins, and polyesters, and the elastomeric polymer is selected from the group consisting of thermoplastic polyurethanes, thermoplastic polyester elastomers, thermoplastic polyolefins, thermoplastic polyesteramide elastomers and thermoplastic polyetheresteramide elastomers.

7. The fiber of claim 1, further comprising an additive added to the wing polymer to improve adhesion of the wings to the core, wherein the fiber has a delamination rating below about 2.5.

8. The fiber of claim 7, wherein the non-elastomeric polymer is selected from the group consisting of (a) poly (hexamethylene adipamide) and copolymers thereof with 2-methylpentamethylene diamine and (b) polycaprolactam, and the elastomeric polymer is polyetheresteramide.

9. A garment comprising the fiber of claim 1.

10. A melt spinning process for spinning continuous polymeric fiber comprising:

passing a melt comprising a non-elastomeric polymer and a melt comprising an elastomeric polymer through a spinneret to form a stretchable synthetic polymer fiber having a plurality of wings attached to a core, wherein at least one of the wing polymer or core polymer protrudes into the other polymer; quenching the fibers after they exit the spinneret to cool the fibers; and collecting the fibers.

11. The process of claim 10 comprising an additional step, after the quenching, of heat-relaxing the fiber so that it exhibits at least about 20% after boil-off stretch.

12. The process of claim 11 wherein the heat-relaxing step is carried out with a heating medium of dry air, hot water or superatmospheric pressure steam at a temperature in the range of about 80° C. to about 120° C. when the heating medium is said dry air, about 75° C. to about 100° C. when the heating medium is said hot water, and about 101° C. to about 115° C. when the heating medium is said superatmospheric pressure steam.

13. The process of claim 10 comprising an additional step, after the quenching, of relaxing the fiber in the range of about 1% to about 35%, based on the length of the fiber before relaxing.

* * * * *